US008786428B2

(12) United States Patent
Sheardown et al.

(10) Patent No.: US 8,786,428 B2
(45) **Date of Patent: *Jul. 22, 2014**

(54) TRACK WORKER SAFETY INFORMATION SYSTEM AND METHOD

(75) Inventors: Keith Burton Sheardown, Mississauga (CA); Mark Willer, King City (CA); Pankaj Sood, Brampton (CA); Nerraj Sood, Brampton (CA); Peter Basl, Hamilton (CA)

(73) Assignee: Bombardier Transportation GmbH, Berlin (DE)

( * ) Notice: Subject to any disclaimer, the term of this patent is extended or adjusted under 35 U.S.C. 154(b) by 544 days.

This patent is subject to a terminal disclaimer.

(21) Appl. No.: 13/097,403

(22) Filed: Apr. 29, 2011

(65) Prior Publication Data

US 2011/0278401 A1 Nov. 17, 2011

Related U.S. Application Data

(60) Provisional application No. 61/334,663, filed on May 14, 2010.

(51) Int. Cl.
*G08B 1/08* (2006.01)

(52) U.S. Cl.
USPC ..... 340/539.13; 340/572.1; 340/539.23; 246/122 R; 246/124; 246/477

(58) Field of Classification Search
USPC ..... 340/573.1
See application file for complete search history.

(56) References Cited

U.S. PATENT DOCUMENTS

| | | | | |
|---|---|---|---|---|
| 5,727,758 | A * | 3/1998 | Penza et al. | 246/124 |
| 6,113,037 | A * | 9/2000 | Pace | 246/124 |
| 6,145,792 | A * | 11/2000 | Penza et al. | 246/167 A |
| 7,624,952 | B1 * | 12/2009 | Bartek | 246/124 |
| 8,344,877 | B2 * | 1/2013 | Sheardown et al. | 340/539.13 |
| 2011/0006912 | A1 | 1/2011 | Sheardown et al. | |

FOREIGN PATENT DOCUMENTS

| | | | |
|---|---|---|---|
| DE | 2619947 | A * | 11/1977 |
| JP | 10203368 | A * | 8/1998 |
| JP | 2000106934 | A | 4/2000 |
| KR | 2010044339 | A * | 4/2010 |
| KR | 2011032276 | A * | 3/2011 |

OTHER PUBLICATIONS

"Railroad Crossing Surveillance & Trespassing Detection System", USA Signal Technology, Apr. 17, 2006, 26 pages.
Dasilva et al., "Railroad Infrastructure Trespassing Detection Systems Research in Pittsford, New York", DOT/FRA/ORD-06/03, Aug. 2006, 50 pages.

* cited by examiner

*Primary Examiner* — Travis Hunnings
(74) *Attorney, Agent, or Firm* — The Webb Law Firm

(57) ABSTRACT

In a method of operating a system for announcing the presence of one or more individuals on or near a pathway to an operator of a vehicle traveling on the pathway, each of a number of data readers positioned along the pathway receives data input by the one or more individuals. In response to each data reader receiving the data input, a unique subset of a number of lamps, also positioned along the pathway, is caused to illuminate. The system includes a computer network that controls the operation of the lamps in response to the input of data.

23 Claims, 18 Drawing Sheets

TRACK WORKER SAFETY INFORMATION SYSTEM AND METHOD

CROSS REFERENCE TO RELATED APPLICATION

The present invention claims priority from U.S. Provisional Patent Application No. 61/334,663, filed May 14, 2010, which is incorporated herein by reference.

BACKGROUND OF THE INVENTION

1. Field of the Invention

The present invention relates to protecting mobile track workers at the track level by utilizing enhanced location awareness and providing information regarding the location of the track workers to train operators in a timely manner.

2. Description of Related Art

To enable safe operation of rail services, railway tracks need to be visually inspected periodically, e.g., every 48 to 72 hours. Unfortunately, the workers responsible for inspecting the tracks and making sure the tracks are safe are generally at risk during track inspections as well as repair and maintenance operations by vehicles (trains) moving along the tracks when the workers are present.

During a time when there is a high level of rail traffic on tracks, workers have to decide the optimal amount of time that is spent performing inspection, repair, and/or maintenance activities before leaving the track to a safe zone. Spending too little time on the track has an impact on productivity and not leaving the track in a timely fashion increases the probability of injuries or fatalities.

SUMMARY OF THE INVENTION

The invention is computer-implemented method for providing warning notifications about one or more track workers along a track. The method comprises: detecting a presence of the one or more track workers along the track via a network of detectors coupled to a communications network; and controlling broadcast of one or more human-perceivable indications across the communications network to one or more broadcast units based on the presence of the track workers.

Detecting the presence of the one or more track workers can include detecting one or more devices on the one or more track workers.

The method can further include detecting the presence of at least one train on the track.

Generating the one or more human-perceivable indications can include generating a visual indication or an audible indication. The visual indication can be flashing light at the one or more broadcast units. The audible indication can be an audible message at the one or more broadcast units.

The method can further include alerting a train operator within the one or more trains using the visual indication.

The method can further include generating the visual indication in a vicinity of the one or more track workers or in a vicinity of the one or more trains such that the visual indication is noticeable by the one or more track workers or the train operator.

The method can further include controlling the visual indication based on movement of the one or more track worker or the one or more trains.

The method can further include generating a human-perceivable indication to the one or more track workers confirming detection of the presence of the one or more track workers.

The method can further include generating a caution message as part of the human-perceivable indication.

The method can further include controlling the frequency of the flashing light.

The method can further include generating either a prerecorded message or a live message as part of the audible message.

The method can further include selecting some or all of the broadcast units for output of the one or more human-perceivable indications.

The invention is also a system for providing notification of the presence of one or more track workers along a track comprising: one or more identification readers situated along a length of the track and operative for reading one or more identification tags carried by the one or more track workers; one or more beacons situated along the length of the track for broadcasting notifications regarding the location of the one or more track workers along the track; and a communication network linking the tag readers and the beacons to a processor controlled data processing system.

At least one identification reader can include a human machine interface to allow one of the track workers to input data into the data processing system.

The system can further include one or more broadcast units, each broadcast unit integrating at least one identification reader and at least one beacon.

Each broadcast unit can be networked via the communication network and controlled by the data processing system.

Each beacon can include means for providing a visual indication, an audible indication, or both.

Each identification reader can include means to confirm identification of the one or more track workers.

More than one beacon can broadcast the notifications.

The communication network can be a wired communication network, a wireless communication network, or a combination of a wired and wireless communication network.

The communication network can be a wired communication network comprising one or more of the following: network-based communication, optics-based communication, and cable-based communication.

The invention is also a computer-implemented method of announcing the presence of one or more individuals on or near a pathway to an operator of a vehicle traveling on the pathway. The method comprises (a) providing a plurality of detectors coupled to a communications network and positioned along the pathway; (b) providing a plurality of indicators coupled to the communications network and positioned along the pathway, wherein each indicator is operative for outputting a human detectable indication; and (c) in response to each detector acquiring data regarding the one or more individuals, causing via the communications network a unique subset of the indicators to output indications.

First and second subsets of indicators outputting indications in response to first and second detectors acquiring data regarding the one or more individuals has at least one indicator in common. The first and second detectors can be positioned one after another along the pathway without any intervening detector between the first and second detectors.

Each unique subset of indicators in step (c) can include a first indicator positioned on one side of the detector that acquired the data that caused the unique subset of indicators to output indications and a second illuminated indicator positioned on the other side of said detector.

Each indicator can include a light producing means. Each indication can include illumination of the at least one light producing means in either a continuously-on state or a flashing state. The vehicle traveling on the pathway can pass the first and second indicators in that order. The light producing means can include the first indicator illuminated in the flashing state and/or the second indicator illuminated in the continuously-on state.

Each unique subset of indicators in step (c) can further include at least one of the following: a third indicator positioned between the first and second indicators; and a fourth indicator positioned on a side of the first indicator opposite the second indicator.

Each indicator can include one of the following: an LED; an LED or LCD visual display; an incandescent light; a fluorescent light; or a metal halide (or HID) light. Each detector can include one of the following: a magnetic card reader; an RFID reader; or a biometric reader.

Step (c) can include: in response to a first detector acquiring data regarding the one or more individuals, causing a first subset of the indicators to output indications; and in response to a second detector acquiring data regarding the one or more individuals, causing a second subset of the indicators to output indications and causing at least one indicator of the first subset of indicators to terminate outputting an indication.

The method can further include: providing means for detecting the presence of the vehicle and, in response to the presence of the vehicle moving by one of the indicators that is outputting an indication being detected by the means for detecting, causing an audible sound to be output.

The method can further include: providing means for detecting the presence of the vehicle and in response to the presence of the vehicle moving by one of the indicators that is outputting an indication being detected by the means for detecting, causing a second subset of indicators to output indications concurrent with the first subset of indicators outputting indications. The first and second subsets of indicators can output indications in opposite directions along the pathway.

The communications network can include means for processing data acquired by a subset of the detectors and for controlling the operation of a subset of the indicators. The subset of the detectors includes all or less than all of the detectors. The subset of indicators includes all or less than all of the indicators.

The means for processing data can include a plurality of processing units, with each processing unit programmed to process data acquired by at least one detector and to control the operation of at least one indicator.

Lastly, the invention is a system of announcing the presence of one or more individuals on or near a pathway to an operator of a vehicle traveling on the pathway. The system comprises: a plurality of detectors positioned along the pathway, wherein each detector is operative for acquiring data regarding the one or more individuals; a plurality of indicators positioned along the pathway, wherein each indicator is operative for outputting a human detectable indication; and a communication network including means for processing data acquired by the detectors and for controlling the operation of the indicators, wherein the means for processing data operating under the control of non-transitory computer program code is responsive to each detector acquiring data regarding the one or more individuals for causing a unique subset of the indicators to output indications.

Each unique subset of indicators can include a first indicator spaced from one side of the detector that acquired the data that caused the unique subset of indicators to output indications and a second indicator spaced from the other side of said detector. The vehicle traveling on the pathway can pass the first and second indicators in that order. The first indicator can output an indication in the form of a flashing light and the second indicator can output an indication in the form of a continuously-on light.

Each unique subset of indicators can further include at least one of the following: a third indicator positioned between the first and second indicators; and a fourth indicator positioned on a side of the first indicator opposite the second indicator.

Each indicator can include one of the following: an LED, an LED or LCD visual display, an incandescent light, a fluorescent light, or a metal halide (or HID) light. Each detector can include one of the following: a magnetic card reader, an RFID reader, or a biometric reader.

The communication network can include means for detecting the presence of the vehicle communicatively coupled to the means for processing data, wherein the means for processing data is responsive to the means for detecting the presence of the vehicle moving by one of the indicators for causing at least one of the following: an audible sound to be output; and a second subset of indicators to output indications.

The first and second subsets of indicators can output indications in opposite directions along the pathway.

The means for processing data can include a plurality of networked processing units, with each processing unit programmed to process data acquired by at least one detector and to control the operation of at least one indicator.

DETAILED DESCRIPTION OF THE INVENTION

The present invention will now be described with reference to the accompanying figures where like reference numbers correspond to like elements.

Figure 1:
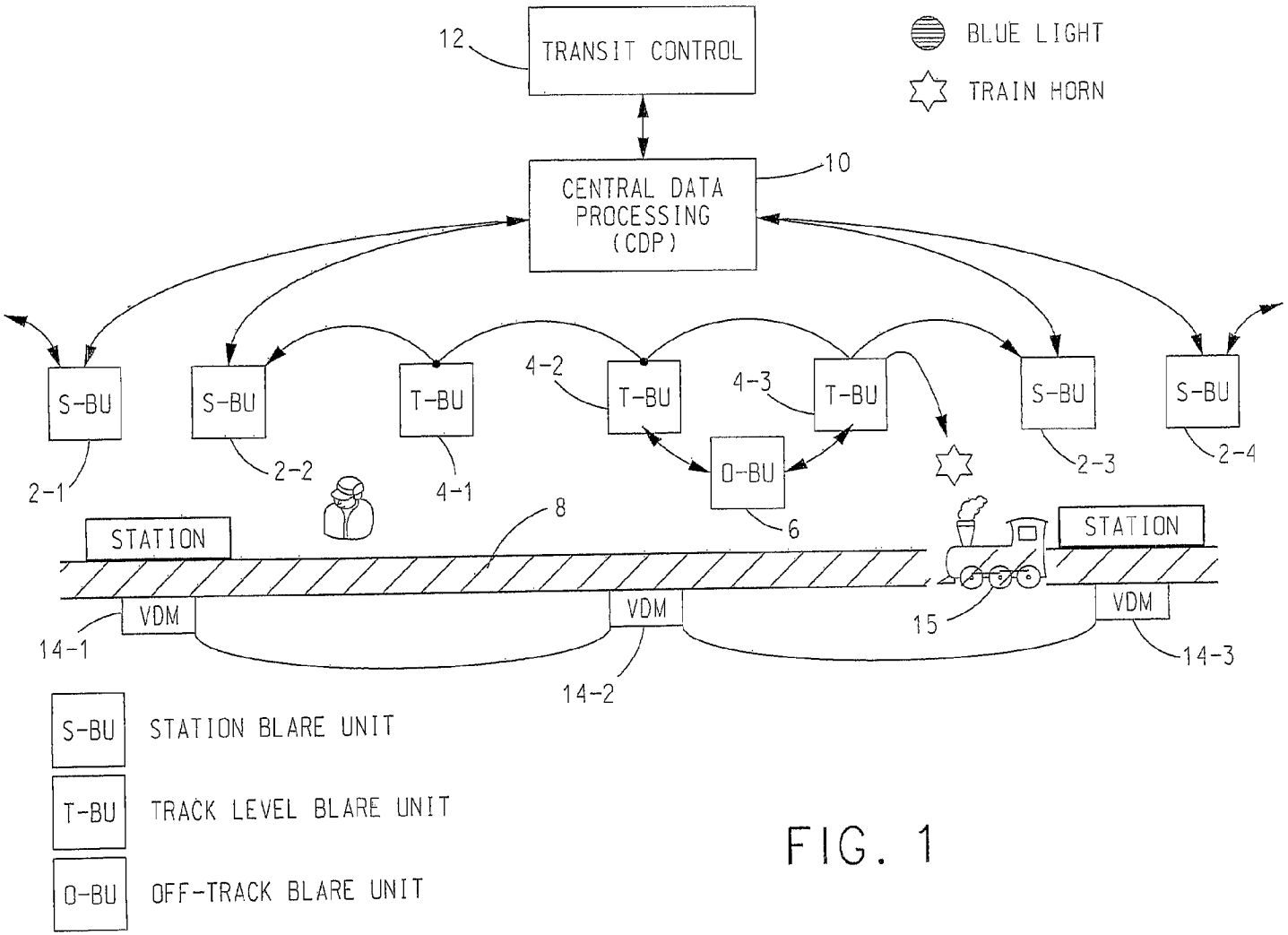
FIG. 1 is a diagrammatic view of a track worker's safety information system in accordance with the present invention.

With reference to FIG. 1, a system for improving the safety of railway track side workers in accordance with the present invention includes a plurality of Blue Light and Reader Equipment (BLARE) units 2, 4, and, optionally, 6 distributed along a predetermined pathway 8 that is configured to facilitate the safe and effective movement of a vehicle 15, such as, without limitation, trains, people movers, and the like. Herein, pathway 8 will be described as including tracks that facilitate the movement of a rail vehicle in a manner known in the art. However, this description is not to be construed as limiting the invention since it is envisioned that pathway 8 can be of any suitable and/or desirable form that facilitates the movement of rail and/or non-rail vehicles along a predetermined path, including, without limitation, a tire mounted vehicle (e.g., a people mover).

The BLARE units 2, 4, and 6 illustrated in FIG. 1 include Station BLARE Units (S-BU) 2-1-2-4, Track level BLARE Units (T-BU) 4-1-4-3, and an optional Off-track BLARE Unit (O-BU) 6.

Each BLARE unit 2, 4, and, optionally, 6 is communicatively coupled to a central data processing unit (CDP) 10. The manner in which BLARE units 2, 4, and, optionally, 6 are coupled and manner in which CDP 10 is coupled one or more to BLARE units 2, 4, and, optionally, 6 is not important. To this end, the connection between BLARE units and between CDP 10 and BLARE units can be wired and/or wireless. Accordingly, the wired connections of CDP 10 and the BLARE units shown in FIG. 1 are not to be construed as limiting the invention.

CDP 10 can be communicatively coupled to a transit control 12 which receives track worker data from the BLARE units and which is operative for scheduling pathway 8 inspections, granting access to one or more pathways 8, causing alerts to be generated, etc., all in coordination with the movement of one or more vehicles 15 on one or more pathways 8.

BLARE units 2, 4, and, optionally, 6 comprise a computer network that may also include CDP 10 and/or transit control 12.

One or more vehicle detection mechanisms (VDM) 14 can be positioned along the length of pathway 8 for detecting when a vehicle 15 is about to enter an active protection zone (described hereinafter). Each VDM 14 is communicatively coupled to an S-BU unit 2 which is operative for receiving signals and/or data output by the VDM 14 regarding when vehicle 15 is about to enter an active protection zone. In FIG. 1, VDMs 14-1, 14-2, and 14-3 are shown distributed along the length of pathway 8. However, the number and/or location of each VDM 14 shown in FIG. 1 is not to be construed as limiting the invention since it is envisioned that each VDM 14 can be positioned at any suitable and/or desirable location deemed necessary and/or expedient by one of ordinary skill in the art.

Figure 2:
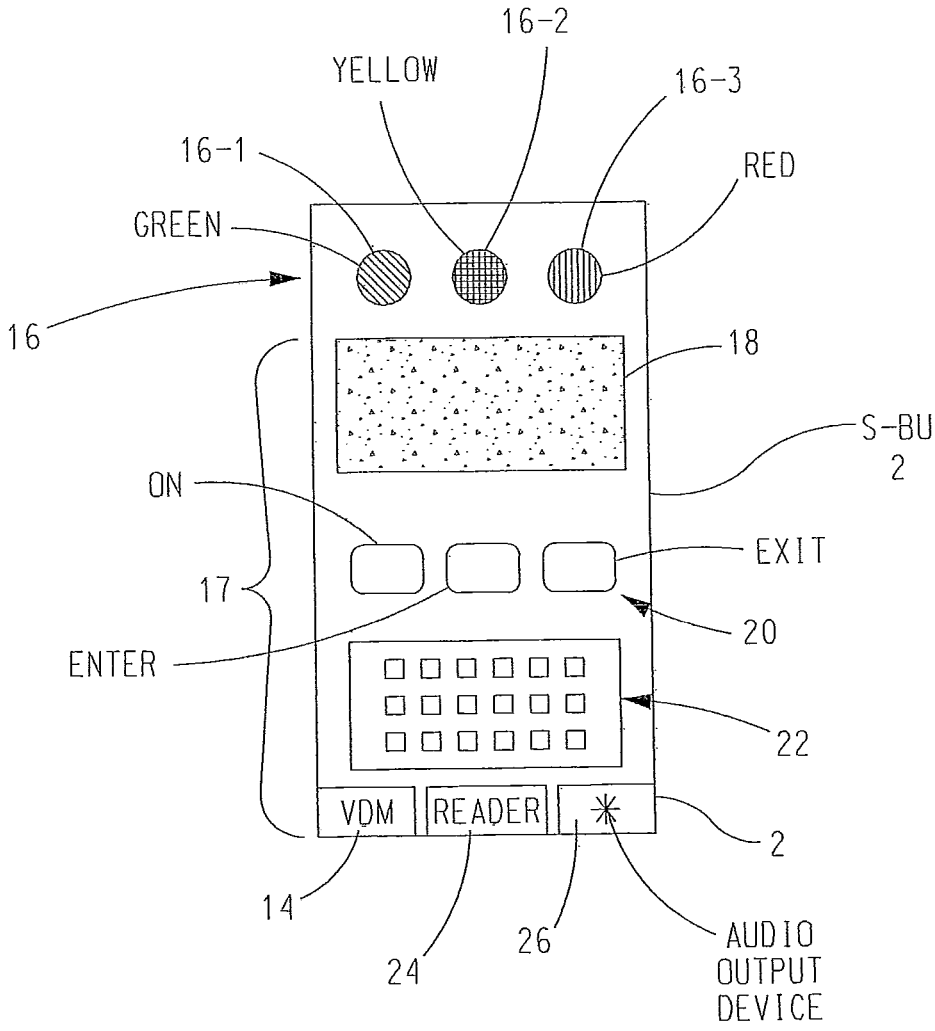
FIG. 2 is a diagrammatic view of a station BLARE unit (S-BU) shown in FIG. 1.

With reference to FIG. 2 and with continuing reference to FIG. 1, in one non-limiting embodiment, each Station BLARE unit (S-BU) 2 includes a color display means 16 that is operative to display different colors. In the non-limiting embodiment of S-BU unit 2 shown in FIG. 2, color display means is operative for individually displaying the colors green 16-1, yellow 16-2, and red 16-3. However, this is not to be construed as limiting the invention since it is envisioned that any suitable and/or desirable colors can be displayed.

Desirably, each color is activated individually, with illumination of green 16-1 indicating worker access to the track level has been granted, with illumination of yellow 16-2 indicating that workers will be allowed access to the track level after the conclusion of an event, such as, without limitation, another group of workers exiting the track level, the passage of a vehicle 15, etc., and with illumination of red 16-3 indicating that workers are not permitted to access the track level. Reasons for not permitting workers to access the track level include, without limitation, said workers not being on a predetermined list of workers permitted to access the track level, a period of high-vehicle usage of pathway 8, and the like.

S-BU unit 2 can also include a human machine interface (HMI) 17. In the non-limiting embodiment of S-BU unit 2 shown in FIG. 2, HMI 17 includes an LCD display 18 and, optionally, buttons 20 and a keypad 22. Where LCD display 18 is a touch screen, the functions of buttons 20 and/or keypad 22 can be incorporated into LCD display 18 and buttons 20 and/or keypad 22 can be omitted. Similarly, the functions performed by color display means 16 may also be incorporated into LCD display 18, whereupon color display means 16 can also be omitted. For the purpose of discussion hereinafter, it will be assumed that buttons 20, keypad 22 and color display means 16 are separate from LCD display 18. However, this is not to be construed as limiting the invention since buttons 20, keypad 22 and/or color display means 16 can be incorporated into LCD display 18 in the form of a touch screen display.

Each S-BU unit 2 desirably includes or is coupled to a vehicle detection mechanism (VDM) 14 that is operative for detecting when a vehicle 15 is about to enter an active protection zone and for outputting a indication of such to the S-BU unit 2. Each S-BU unit 2 further includes a reader 24 and an optional audio output device 26. Reader 24 can be any suitable and/or desirable type of reader that is capable of detecting a code embedded in a device or biometric data, such as, without limitation, a fingerprint, a palm print, a face scan, and/or retinal pattern. Audio output device 26 can be any suitable and/or desirable device, such as an audio speaker, a piezoelectric element, and the like, that is capable of outputting sound.

Figure 3:
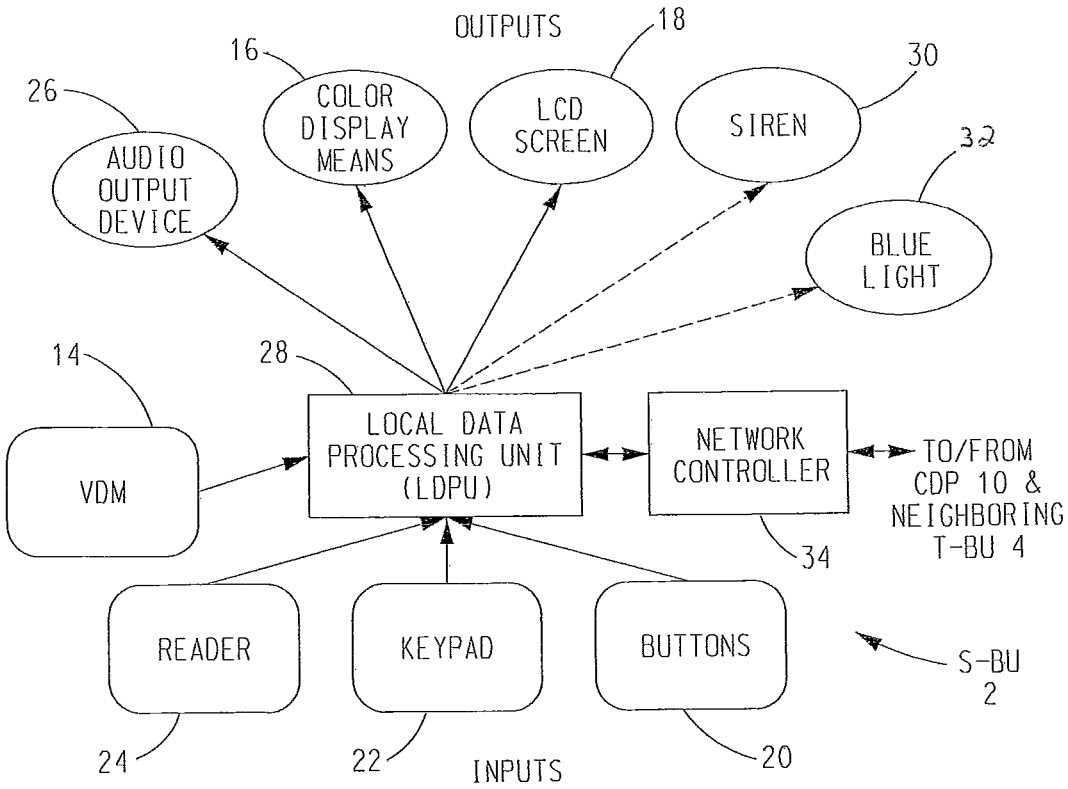
FIG. 3 is a block diagram of the S-BU shown in FIG. 2 coupled (by dashed lines) to a siren and blue light which operate under the control of the local data processing unit (LDPU) of the S-BU.

With reference to FIG. 3 and with continuing reference to FIGS. 1 and 2, each S-BU unit 2 includes a local data processing unit (LDPU) 28 that is configured and programmed to control the operations of color display means 16, LCD display 18, buttons 20, keypad 22, reader 24, and audio output device 26. Each S-BU unit 2 is desirably coupled to siren 30 and another color display means 32 (e.g., a blue light) that is operative for displaying a desired colored light under the control of LDPU 28. S-BU unit 2 can also include a network controller 34 that facilitates communication between S-BU unit 2, CDP 10 and other devices on the network. Network controller 34 can implement a wired or wireless connection.

Buttons 20 include an ON button that when pressed causes S-BU unit 2 to activate; an ENTER button that when pressed causes S-BU unit 2 to initiate a track authorization process with transit control 12 for workers desiring to enter the track level where S-BU unit 2 is located; and an EXIT button that when pressed causes S-BU unit 2 to communicate to transit control 12 an indication that workers are exiting the track level. Desirably, all communications between LDPU 28 of S-BU unit 2 and transit control 12 occur via network controller 34 and CDP 10.

Keypad 22 can be used as an optional means of communication between S-BU unit 2 and transit control 12. For example, keypad 22 enables the entry into the LDPU 28 of S-BU unit 2 of access codes, employee numbers of workers on the track level, and/or any other suitable and/or desirable data.

Audio output device 26 is operative for outputting a suitable sound, e.g., a beep, under the control of LDPU 28 in response to a successful read by reader 24. When siren 30 is coupled to S-BU unit 2, it can output an optional audio sound under the control of LDPU 28. Similarly, if color display means (e.g., blue light) 32 is coupled to S-BU unit 2, it can be activated under the control of LDPU 28 to display a flashing or continuously-on blue light. Color display means (blue light) 32 is desirably positioned in close proximity to S-BU unit 2, for example, without limitation, on, in, or near the enclosure that houses S-BU unit 2.

Figure 4:
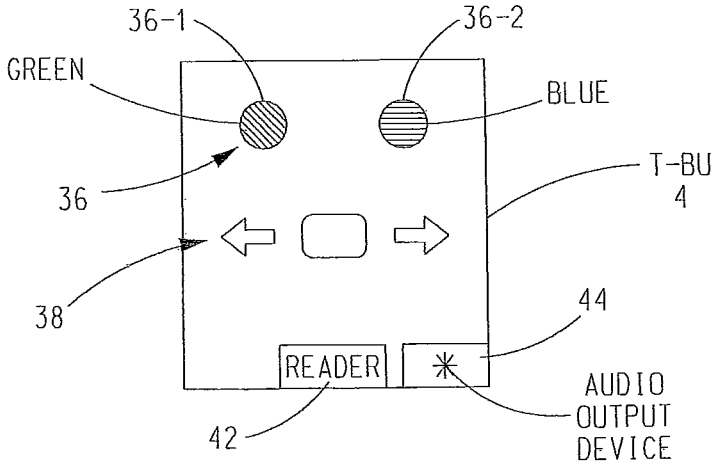
FIG. 4 is a diagrammatic view of a track level BLARE unit (T-BU) shown in FIG. 1.

With reference to FIG. 4, in one non-limiting embodiment, each T-BU unit 4 includes a color display means 36 and buttons 38. In the non-limiting embodiment shown in FIG. 4, color display means 36 is operative for individually displaying the colors green 36-1 and blue 36-2. Buttons 38 can include left and right arrow buttons for indicating which direction workers are going to walk at the track level and a square button that can be utilized to indicate the possibility of crossing the current pathway 8 to an adjacent pathway, whereupon a double protection zone can be enabled. While color display means 36 has been described and illustrated as having separate means for displaying the colors green 36-1 and blue 36-2, it is envisioned that these colors (and others) can be incorporated into an LCD display, a single housing, or any other suitable and/or desirable means for individually displaying the colors green and blue. It is envisioned that the functions of color display means 36 and/or buttons 38 can be incorporated into an LCD display (not shown) in the form of a touch screen display.

Figure 5:
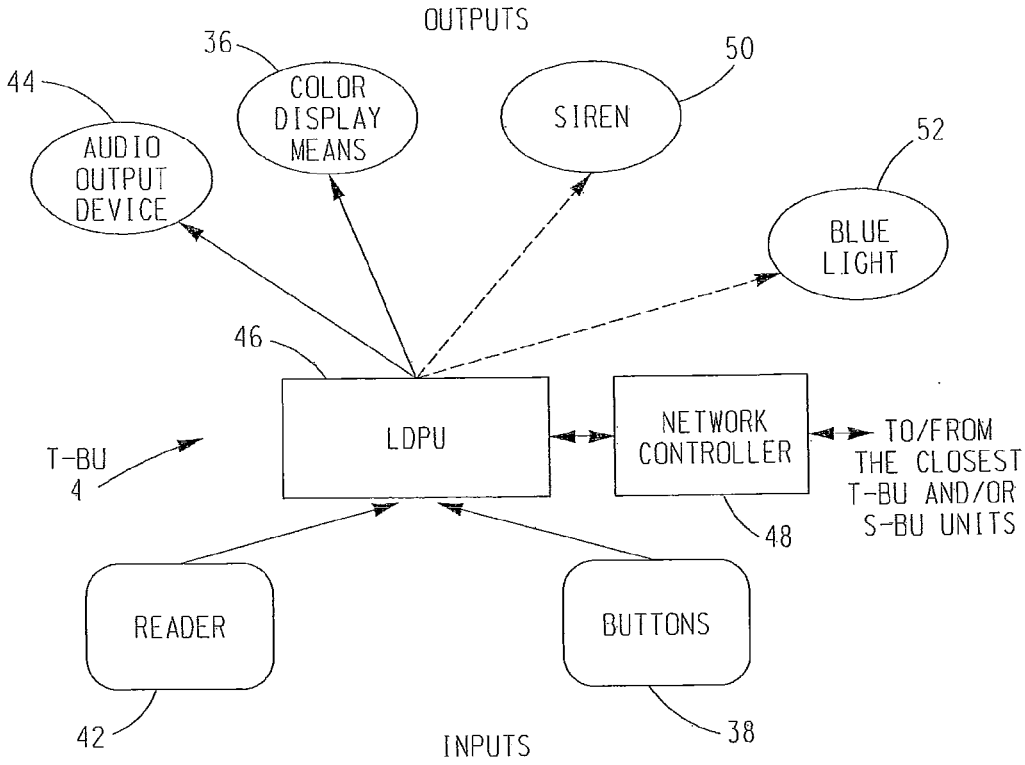
FIG. 5 is a block diagram view of the T-BU unit shown in FIG. 4 coupled (by dashed lines) to a siren and blue light which operate under the control of the LDPU of the T-BU.

With reference to FIG. 5 and with continuing reference to FIG. 4, T-BU unit 4 also includes a reader 42, like reader 24, an audio output device 44, like audio output device 26, an LDPU 46, like LDPU 28, and a network controller 48, like network controller 34.

Each network controller 34 and 48 can operate either as a node of the computer network, where each node has direct access to CDP 10, or a network repeater through which each network message passes between nodes connected to either side of said network controller 34 or 48. In the embodiment illustrated in FIG. 1, the network controller 34 of S-BU unit 2-2 is coupled to CDP 10 and the network controller 48 of T-BU unit 4-1. The network controller 48 of T-BU unit 4-1 is also connected to the network controller 48 of T-BU unit 4-2. If O-BU unit 6 is not present, the network controller 48 of T-BU unit 4-2 is connected to the network controller 48 of T-BU unit 4-3. On the other hand, if O-BU unit 6 is present, the network controller of T-BU unit 4-2 is connected to the network controller (described hereinafter) of O-BU unit 6 which, in turn, is connected to the network controller 48 of T-BU unit 4-3. The connection of BLARE units 2, 4, and, optionally, 6 in FIG. 1, whereupon data and signals pass through each network controller thereof, is not to be construed as limiting the invention.

T-BU unit 4 can optionally be coupled to a siren 50, like siren 30, and another color display means 52 (e.g., a blue light), like color display means 32.

Figure 6:
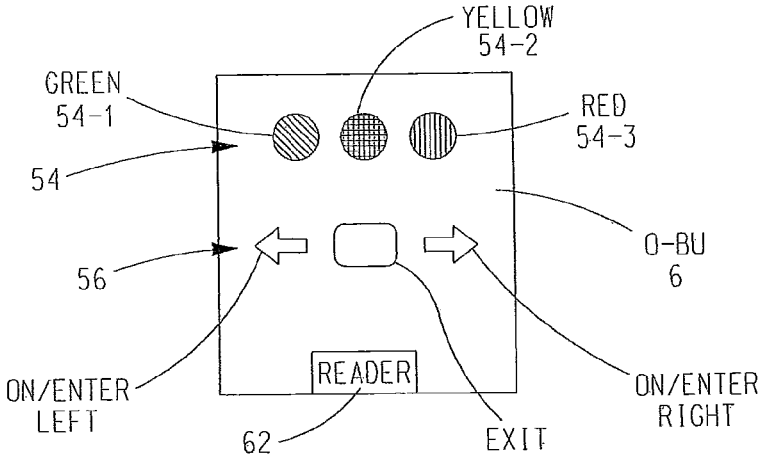
FIG. 6 is a diagrammatic view of an off-track BLARE unit (O-BU) shown in FIG. 1.

With reference to FIG. 6 and with continuing reference to all previous figures, O-BU unit 6 includes buttons 56 and in one non-limiting embodiment, color display means 54 which is operative for individually displaying the colors green 54-1, yellow 54-2, and red 54-3. However, this is not to be construed as limiting the invention since it is envisioned that any suitable and/or desirable colors can be displayed. Buttons 56 can include a left arrow button, a right arrow button, and a center button. However, this is not to be construed as limiting the invention.

Figure 7:
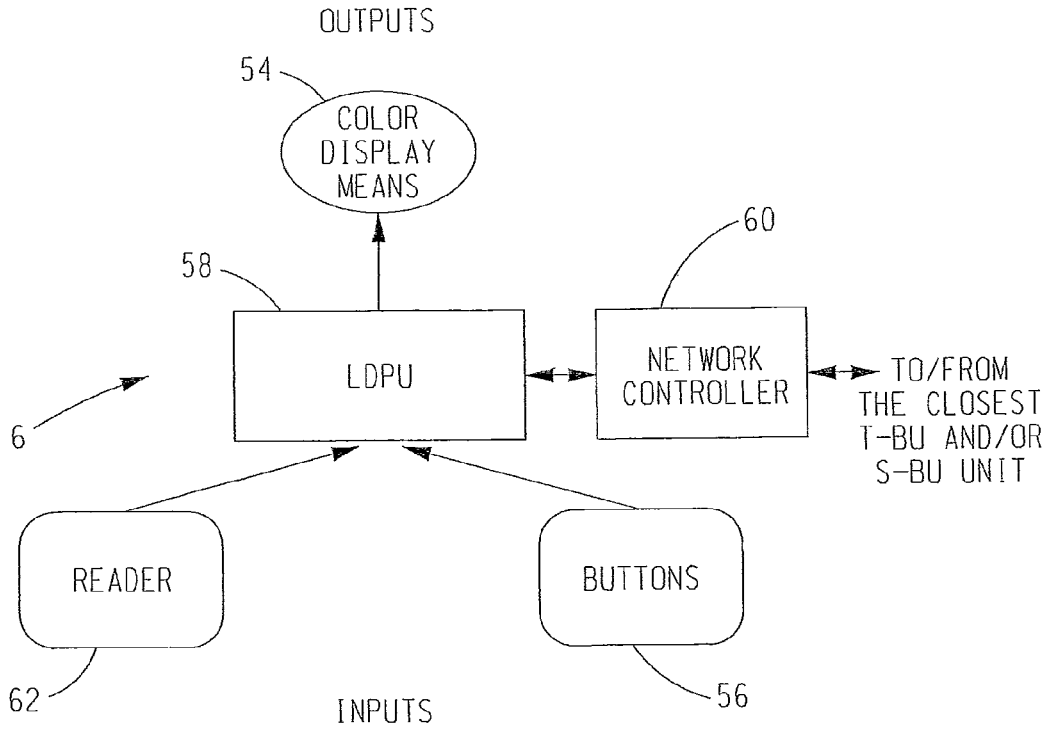
FIG. 7 is a block diagram view of the O-BU shown in FIG. 6.

With reference to FIG. 7 and with continuing reference to FIG. 6, O-BU unit 6 includes an LDPU 58, like LDPU 28, a network controller 60, like network controller 34, a reader 62, like reader 24, color display means 54, and buttons 56, all connected in the manner shown in FIG. 7.

Depending on the physical location of O-BU unit 6, network controller 60 can be connected to the closest T-BU or S-BU unit. While color display means has been described and illustrated as having separate means for displaying the colors green 54-1, yellow 54-2, and red 54-3, it is envisioned that these colors (and others) can be incorporated into an LCD display, a single housing, or any other suitable and/or desirable means for individually displaying the colors green, yellow, and red. It is envisioned that the functions performed by the display means 54 and/or buttons 56 can be incorporated into an LCD display in the form of a touch screen display.

The operation of each BLARE unit 2, 4, and 6 will now be described.

With reference back to S-BU unit 2 shown in FIG. 2, the color green 16-1 is illuminated (turned on) when access to the track level is granted and workers can proceed to the track level. The color yellow 16-2 is illuminated (turned on) when workers have been granted access to the track level but need to wait for access, e.g., because the track level is currently occupied by other workers. The color red 16-3 is illuminated (turned on) when workers are not allowed access to the track level. It is envisioned that each color 16-1-16-3 is illuminated independent of the other colors. In general, colors 16-1-16-3 inform workers of the status of their track level access.

LCD display 18 can be utilized to relay daily briefings or custom security alerts for the track section serviced by S-BU unit 2. It can also display a successful read of worker data via reader 24.

Buttons 20 include an ON button to turn S-BU unit 2 on, an ENTER button that is depressed when workers wish to initiate a track level authorization process by having the workers of the team input their identification into reader 24, and the EXIT button which is depressed to indicate that workers are exiting the track level. The EXIT button can also be used as a cancel button if the workers make a mistake while entering data into reader 24.

Referring now to FIG. 3 and with continuing reference to FIG. 2, reader 24 can be any suitable and/or desirable reader that is capable of reading worker data in the form of data embedded in a device, e.g., without limitation, an RFID card, a magnetic data card, etc., or biometric worker data, e.g., without limitation, a retinal scan, fingerprint scan, a palm print scan, a face scan, and the like. For the purpose of describing the invention, reader 24 will be described as being an RFID reader. However, this is not to be construed as limiting the invention.

Each S-BU unit 2 and, more particularly, each LDPU 28 is programmed to be responsible for a particular track section. This isolation helps avoid system wide disruptions due to local failures. Each LDPU 28, together with its programming and internal logic, is responsible for a host of functions including, without limitation, encoding of different inputs into a suitable digital format that can be effectively and reliably communicated across the computer network. The inputs into LDPU 28 come in a variety of forms including, without limitation, from pushbuttons, electrical data signals from reader 24, and analog train detection signals from a VDM 14 coupled to LDPU 28. LDPU 28 also decodes digital data into electrical, audio, or pixel data according to a format recognized by the intended output device. LDPU 28 also processes received data from sources according to programmed system logic and correctly addresses the results of data processing to a designated system component, such as turning on a suitable light of color display means 16 and causing one or more appropriate blue lights 32 to illuminate according to the direction of travel of vehicle 15 on pathway 8 (discussed hereinafter). LDPU 28 also performs local system health checks, receives system wide emergency or failure alerts, allows temporary data storage which can be used for daily security briefings, custom safety alerts, etc. This latter capability helps decrease network communication demands during daily operations.

Network controller 34 enables S-BU unit 2 to communicate with both CPD 10 and a neighboring T-BU unit 4. Network controller 34 is designed to reliably and efficiently transmit and receive data.

Audio output device 26 is utilized to produce a distinct sound on a successful RFID tag read by reader 24. Lastly, the components comprising vehicle detection mechanism (VDM) 14 can be mounted on, in, or near S-BU unit 2.

Referring now to FIGS. 4-5, T-BU units 4 are located every few hundred meters or so along the pathway 8 and are accessible at the track level. The main role of T-BU units 4 is to track the movement of workers as said workers move along the length of pathway 8. T-BU units 4 also act as network repeaters to ensure the continuity of the computer network in every section of pathway 8 between two S-BU units 2. Each T-BU unit 4 is attached to at least one track level blue light 52 and one siren 50 and controls them in the manner described hereinafter.

The color green 36-1 of color display means 36 is illuminated in response to a successful read of an RFID tag by reader 42. Illumination of blue light 36-2 indicates that an active protection zone (described hereinafter) has been established so the track workers can proceed along pathway 8 in a desired direction. Buttons 38 include left and right arrow buttons which can be activated to indicate the direction the track workers are going to walk. The square, center button can be activated to indicate that the workers are crossing a current pathway 8 to an adjacent, neighboring pathway 8, whereupon a double protection zone (one for each pathway) can be enabled. Hardwarewise, LDPU 46 can be the same as LDPU 28. However, LDPU 46 can have simpler programming than LDPU 28 because LDPU 46 desirably does not perform logic calculations. Rather, LDPU 46 simply encodes and decodes different forms of data received or to be transmitted. One of the main functions of LDPU 46 is controlling the colors of color display 36, the blue light 52, and siren 50. All data processing required is performed by the closest S-BU unit 2 and then communicated to T-BU unit 4. Additionally, each T-BU unit 4 can be self-monitoring and can transmit an alert in case of a failure.

The network controller 48 of each T-BU unit 4 connects to the network controllers of the two closest T-BU units 4 and/or S-BU unit 6. Network controller 48 acts as a network repeater to ensure the continuity of the communication network in a particular section of pathway 8. If an O-BU unit 6 is connected to T-BU unit 4, T-BU unit 4 can communicate with O-BU unit 6 to ensure that said O-BU unit 6 is online in the communication network.

Referring now to FIGS. 6 and 7, each O-BU unit 6 is located at the entrance of an off-pathway entry point, such as a vent shaft, a power room, etc. Each O-BU unit 6 has similar functionalities as an S-BU unit 2 in the sense that the O-BU unit 6 is capable of causing blue lights in a particular section of pathway 8 to be activated or deactivated. Also, access permission to off-track entry points can be controlled using an O-BU unit 6. When workers enter an off-track entry point, any illuminated blue lights in the particular section of pathway 8 are deactivated and then reactivated when the workers return to the track level of pathway 8. Each O-BU unit 6 is connected to the computer network through the two closest S-BU units 2 and/or T-BU units 4.

When illuminated, the color green 54-1 indicates to workers that they are allowed to exit a room and return to the track level of pathway 8. Illumination of the color red 54-3 means permission is not granted. Lastly, illumination of the color yellow 54-2 can indicate delayed access. Buttons 56 include left and right arrow buttons for indicating which direction the workers intend to move when returning to the track level of pathway 8. The middle button can be used to indicate when the workers decide to cross the current pathway 8 to an adjacent, neighboring pathway 8, whereupon a double protection zone can be enabled, one for each pathway 8.

Figure 8:
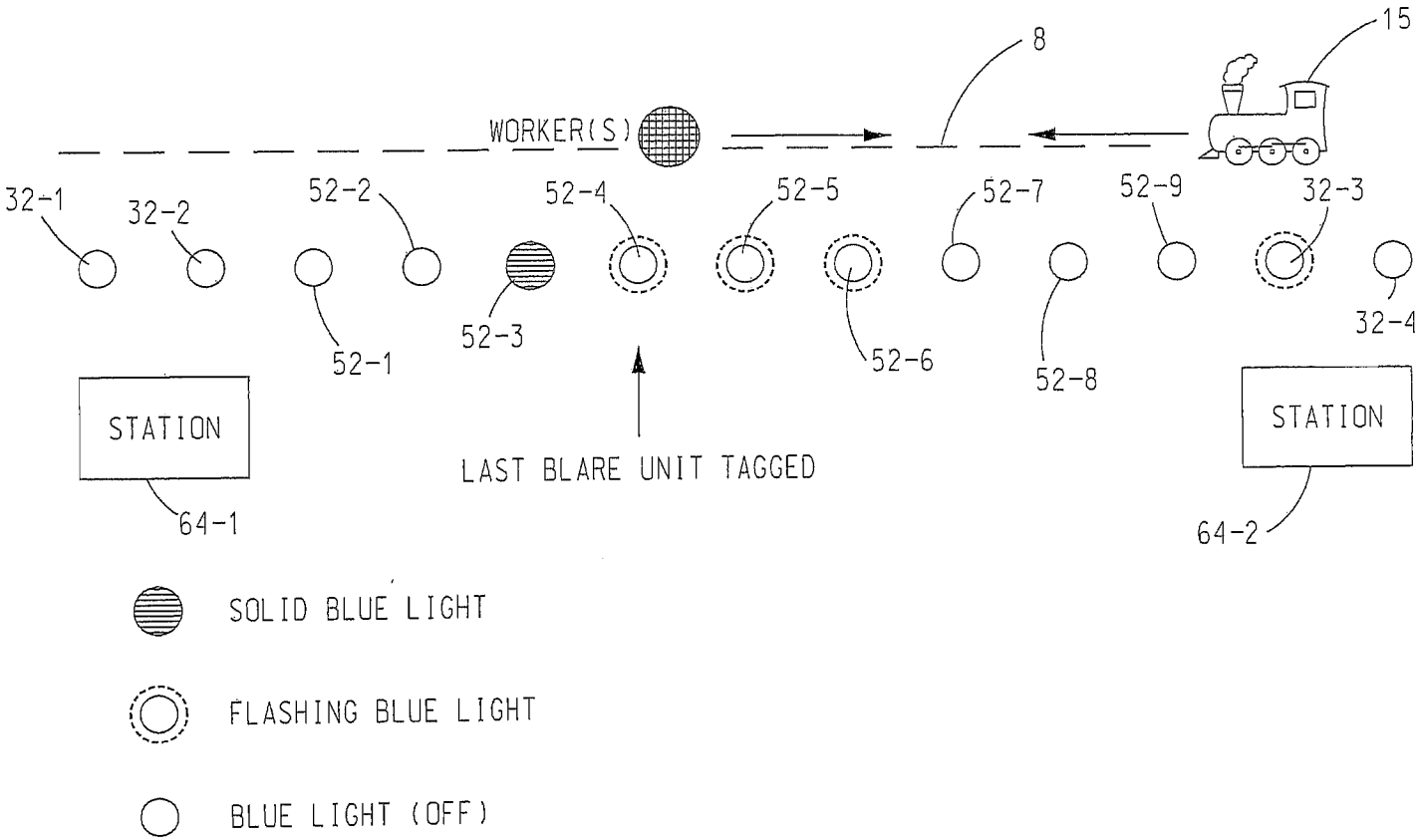
FIG. 8 is a diagrammatic view of an arrangement of blue lights operating under the control of T-BUs and S-BUs, wherein said blue lights are distributed one-after-the-other serially along a pathway upon which a vehicle travels and upon which workers access for inspection.

With reference to FIG. 8 and with continuing reference to all previous figures, each S-BU unit 2 is connected to at least one blue light 32 and each T-BU unit 4 is connected to at least one blue light 52. However, this is not to be construed as limiting the invention since it is envisioned that two or more blue lights may be connected to the same S-BU unit 2 or T-BU unit 4.

Herein, blue lights 32 and 52 are utilized as a visual alert to an operator of vehicle 15, e.g., a train, that he is approaching a zone where there are mobile workers. Each blue light 32 and 52 is positioned on or in close proximate relation to its controlling S-BU unit 2 or T-BU unit 4. While the use of "blue" lights are described herein, this is not to be construed as limiting the invention since the use of any visual color or colors is envisioned. However, "blue" lights will be utilized hereinafter for the purpose of describing the invention.

FIG. 8 is a general illustration of how blue lights 32 and 52 are utilized to establish an active protection zone for mobile track workers. Each blue light 32 and 52 is controlled by its own S-BU unit 2 or T-BU unit 4.

As shown generally in FIG. 8, as one or more workers moves on pathway 8 (from left to right in FIG. 8), a subset of blue lights 52 is illuminated in response to one or more of said workers scanning the reader 62 of each T-BU unit 4 that said worker(s) encounter along said pathway 8. In FIG. 8, a train or other pathway-borne vehicle 15 moves from right to left on pathway 8.

In addition to the solid or flashing illumination of a number of blue lights 52 under the control of T-BU units 4 along pathway 8, desirably, at least one blue light 32 operating under the control of an S-BU unit 2 is illuminated, desirably in a flashing manner. Desirably, the blue light 32 that is illuminated (flashing) is the one at the end of the station 64-2 that vehicle 15 passes before encountering the workers present along pathway 8, e.g., blue light 32-3.

As shown in FIG. 8, in response to scanning one or more worker RFID tags with the reader 62 of the T-BU unit 4 associated with blue light 52-4, blue lights 52-4-52-6 are illuminated in a flashing state and blue light 52-3 is illuminated in a continuously-on (non-flashing) state. At all times when workers are on the track level of pathway 8 between stations 64-1 and 64-2, the blue light 32-3 associated with the S-BU unit 2 of station 64-2 is illuminated in a flashing state.

Herein, in one embodiment, the "protection zone" comprises the illuminated blue lights (either flashing or continuously on) along the track level of pathway 8 where the workers are presently located. In the example shown in FIG. 8, this protection zone extends from continuously-on blue light 52-3 to flashing blue light 52-6. In another embodiment, the "protection zone" includes the illuminated blue lights 52-3-52-6 on the track level of pathway 8 and the illuminated (flashing) blue light 32-3.

The flash rate of each blue light 32 and 52 can be set as desired to warn an operator of vehicle 15 that workers are present on pathway 8. In one exemplary, non-limiting embodiment, the flash rate of each blue light 32 and 52 is set to two flashes per second. However, this is not to be construed as limiting the invention.

Referring back to FIG. 2, the VDMs 14 coupled to S-BU units 2 provide information that vehicle 15 is approaching. In one exemplary embodiment, each VDM 14 comprises a passive infrared sensor that is operative for detecting the presence of objects by measuring heat radiation. Since a vehicle 15, such as a train, will have a large heat radiation pattern as compared to humans or other animals or objects present on pathway 8, the LDPU 28 of the S-BU unit 2 coupled to a VDM 14 is capable of differentiating the output of the infrared sensor of the VDM 14 to readily detect the presence of vehicle 15 on pathway 8.

As shown in FIG. 1, one or more VDMs 14 can be positioned anywhere along the length of pathway 8 deemed suitable and/or desirable. One or more VDMs 14 can be connected to a single S-BU unit 2. For example, in FIG. 1, VDMs 14-1, 14-2, and 14-3 can be connected to S-BU unit 2-3. In another embodiment, VDMs 14-2 and 14-3 can be connected to S-BU unit 2-3 and VDM 14-1 can be connected to S-BU unit 2-2. However, this is not to be construed as limiting the invention.

Regardless of how VDMs 14 and S-BU units 2 are connected, the detection of the movement of vehicle 15 on the track level of pathway 8 between S-BU unit 2-2 and S-BU unit 2-3 is coordinated by one or both of said S-BU units 2-2 and 2-3 via the computer network that comprises said S-BU units 2-2 and 2-3 and any T-BU units 4 therebetween along the track level of pathway 8.

The description herein of each VDM 14 including a passive infrared sensor is not to be construed as limiting the invention since it is envisioned that each VDM 14 can utilize any other suitable and/or desirable sensor modality for detecting the presence of a vehicle 15 on pathway 8. Non-limiting examples of other sensor modalities can include: radar; switches placed along pathway 8; magnetic loop detectors; and the like.

As noted above, each S-BU unit 2 can have a siren 30 coupled thereto and each T-BU unit 4 can have a siren 50 coupled thereto. As discussed above, the flashing and/or continuously-on states of blue lights 32 and 52 provide a visual alert to the operator of vehicle 15 of the presence of workers on the track level of pathway 8. Sirens 30 and 50 can provide an audible alert to workers on the track level of pathway 8 of an approaching vehicle 15 on pathway 8. To this end, one or more sirens 30 and/or 50 can be caused to output an audible sound in response to at least one VDM 14 detecting the presence of vehicle 15 entering the section of pathway 8 where workers are present.

CDP 10, shown in FIG. 1, is a server that is programmed to perform all of the required logic and data storage requirements discussed herein. Transit control 12 provides high-level control and oversight of a track network that includes pathway 8 and provides high-level authorization of workers to enter a pathway.

Hereinafter, the words and/or phrases "tagged", "tag", "tag in", "tagged in", "tagging in", "tag out", "tagged out", "tagging out", "tag read", and the like, are utilized to describe when a reader 24, 42, or 62 of an S-BU unit 2, a T-BU unit 4, or an O-BU unit 6, respectively, reads an RFID tag of at least one worker.

With continuing reference to FIG. 8, in response to a reader 42 of a T-BU unit 4 being tagged, the blue light under the control of said T-BU unit 4, e.g., blue light 52-4, will flash as will some number of blue lights of one or more T-BU units 4 and/or one or more S-BU unit(s) 2 in the direction of the approaching vehicle 15, e.g., blue lights 52-5, 52-6, and 32-3. In addition, the blue light associated with one or more T-BU units 4 and/or S-BU units 2 opposite the direction of the approaching train 15, e.g., blue light 52-3, will illuminate continuously (not flash). For example, if one or more workers moving from left to right on the pathway 8 shown in FIG. 8 tag in at the T-BU unit 4 associated with blue light 52-4, said blue light 52-4 will flash along with blue lights 52-5 and 52-6 while blue light 52-3 will illuminate continuously. Blue light 32-3 associated with an S-BU unit 2 of station 64-2 will flash regardless of the location or position of workers on the section of pathway 8 between stations 64-1 and 64-2. The description herein of blue lights 52-4-52-6 flashing and blue light 52-3 being on continuously in response to workers tagging in at the T-BU unit 4 associated with blue light 52-4, however, is not to be construed as limiting the invention since it is envisioned that any number of blue lights 54 between the T-BU unit 4 associated with blue light 52-4 and station 64-2 can be flashing while any number of blue lights in the direction from the T-BU unit 4 associated with blue light 52-4 and station 64-1 can be illuminated continuously. For the purpose of describing the present invention, the use of four illuminated blue lights 54, three flashing and one on continuously, will be described hereinafter. However, this is not to be construed as limiting the invention.

Various options exist for having workers tag in or tag out of BU units 2 and 4. In a first option, a leader of a group of workers tags in at entry, intermediate, and exit points along a pathway 8 and simply enters the number of workers in the group at the entry and exit points, e.g., S-BU unit 2, along the track level of pathway 8. In a second option, each worker tags in at entry and exit points, e.g., S-BU unit 2, and only the leader of the group of workers tags in at intermediate points, e.g., T-BU units 4. In a third option, all workers tag in at entry, intermediate, and exit points along pathway 8. For the purpose of describing the present invention, the second option for having workers tag in and tag out of entry and exit points of the track level of pathway 8 between station 64-1 and 64-2 will be described. However, this is not to be construed as limiting the invention. Moreover, it is to be appreciated that an entry point and an exit point on pathway 8 can be the same point should the workers enter and leave the track level of pathway 8 via the same S-BU 2.

Desirably, a successful tag read is acknowledged by each BU 2 and 4 outputting a suitable audio signal via its audio output device 26 and 46, respectively. Optionally, one or more lights of the color display means 16 and 36 of each BU 2 and 4 can be illuminated in a pre-determined manner to provide a visual indication of successful and unsuccessful tag reads.

Desirably, S-BU units 2 are placed at the ends of each station 64, as shown in FIG. 1, to permit workers to tag in and tag out as needed from the section (track level) of pathway 8 that extends between said stations and to permit workers to walk in either direction along pathway 8. Thus, each S-BU unit 2 can be considered an entry/exit point for workers to access the track level of pathway 8 that extends between stations 64-1 and 64-2. Herein, each station 64 is a location along pathway 8 that configured to facilitate passenger ingress and egress from vehicle 15 that is configured to travel along pathway 8. The description herein of S-BUs 2 being located at the ends of stations, however, is not to be construed as limiting the invention since it is envisioned that each S-BU 2 can be located at any suitable and/or desirable location along pathway 8 that is to be an entry and/or exit point for workers to access the track level of pathway 8.

A method of controlling the illumination of blue lights 32 and 52 in accordance with the present invention will now be described.

Figure 9:
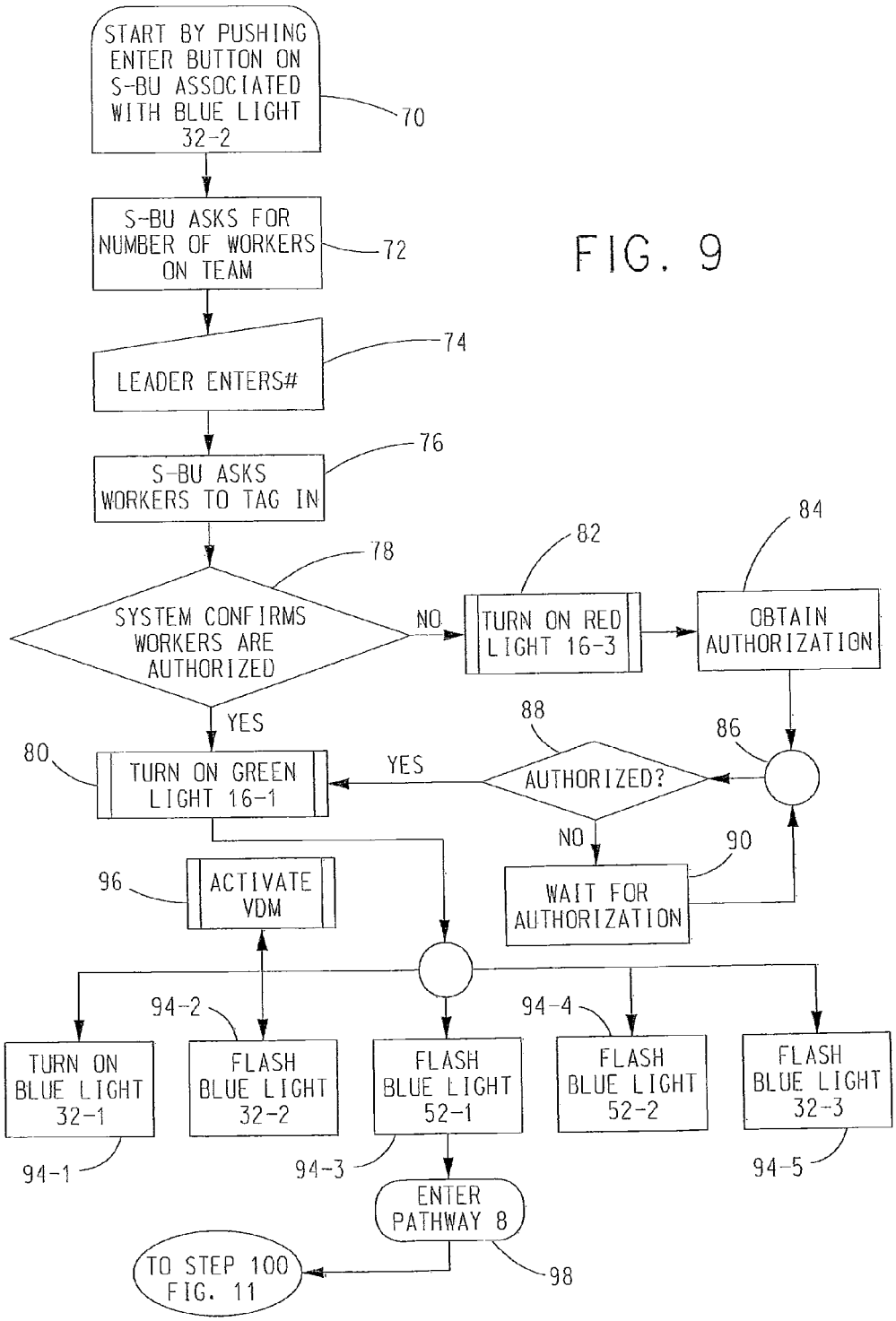
FIG. 9 is a flow chart of a method for authorizing one or more workers to access a track level section of a pathway and the resulting illumination of blue lights in either a continuously-on or flashing state upon granting said one or more workers access to the track level.
Figure 10:
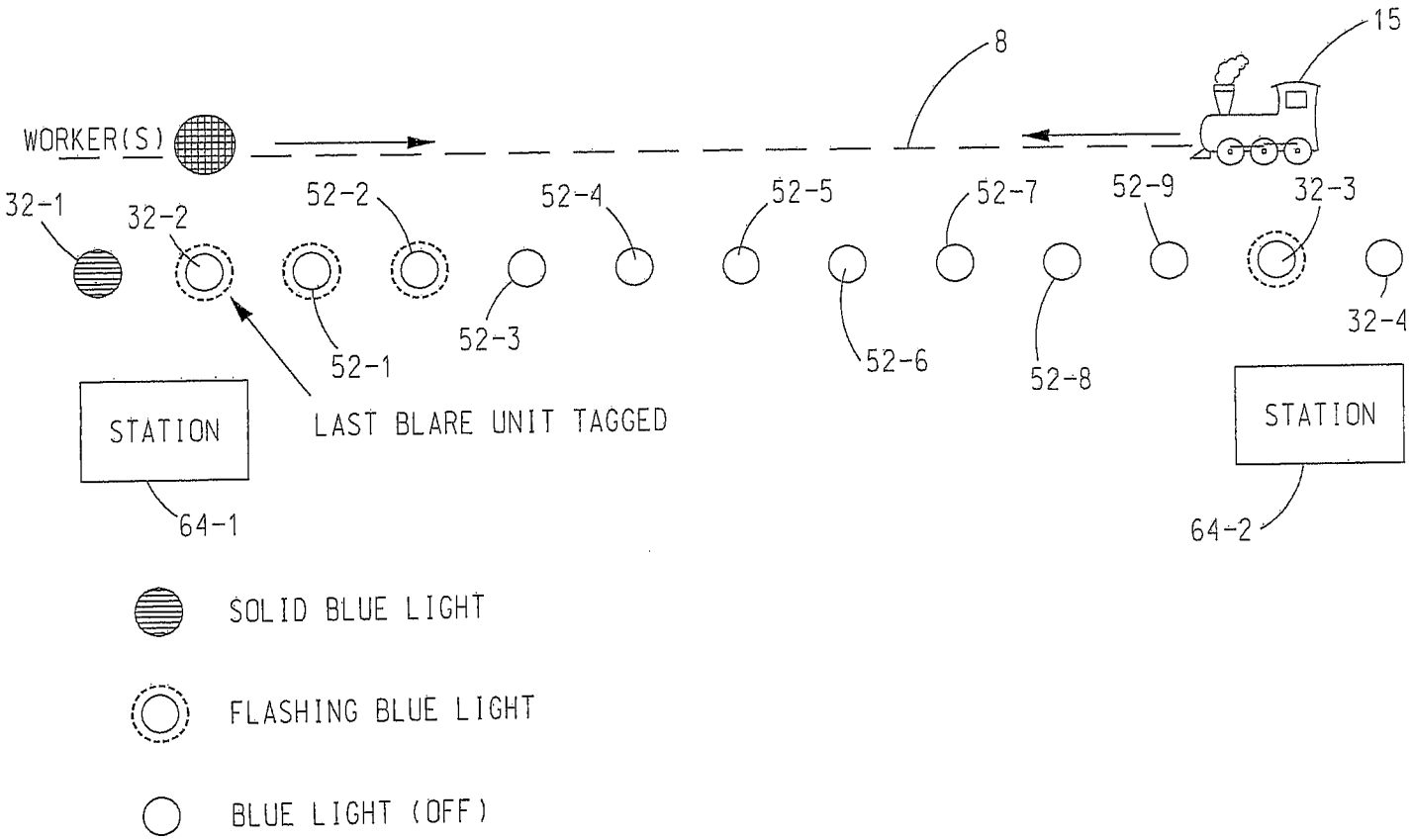
FIG. 10 is a diagrammatic view of the blue lights, a pair of stations, a vehicle pathway, and a vehicle showing the state of the blue lights after workers have been granted access to the track level of the pathway according to the flow diagram shown in FIG. 9.

With reference to FIGS. 9 and 10, and with continuing reference to all previous figures, the method begins at step 70 when one or more track workers desiring to enter the track level of pathway 8 between stations 64-1 and 64-2 presses the ENTER button of S-BU unit 2 associated with blue light 32-2. The method then advances to step 72 wherein under the control of its LDPU 28, the S-BU unit 2 associated with blue light 32-2 outputs a prompt on LCD 18 for the number of workers desiring access to the track level of pathway 8 between stations 64-1 and 64-2. In step 74, one of the workers (hereinafter "the leader") enters the number of workers into S-BU unit 2 associated with blue light 32-2 via keypad 22.

In step 76 the S-BU unit 2 associated with blue light 32-2 outputs a prompt on LCD 18 for each worker associated with the work group to tag in via the reader 24 of said S-BU unit 2.

Desirably, the S-BU unit 2 associated with blue light 32-2 can access a database that includes a listing of pathways 8 that are authorized for access by workers, and, desirably, the workers that have been granted access to the section of pathway 8 between stations 64-1 and 64-2, in this example.

At a suitable time after the workers have tagged in at the S-BU unit 2 associated with blue light 32-2, said S-BU unit 2, in step 78, confirms whether said workers are authorized access to the section (track level) of pathway 8 between stations 64-1 and 64-2. In one non-limiting embodiment, this continuation occurs via CDP 10 which stores the database of pathways 8 that have been authorized access and the workers that have been authorized access to each pathway 8.

In response to the S-BU unit 2 associated with blue light 32-2 confirming that the workers are authorized access to the track level of pathway 8 between station 64-1 and 64-2, the method advances to step 80, wherein the color green 16-1 of the S-BU unit 2 associated with blue light 32-2 is illuminated. On the other hand, if, in step 78 it is determined that the workers are not authorized access to the track level of pathway 8 between stations 64-1 and 64-2, the method advances to step 82 where color red 16-3 of the S-BU unit 2 associated with blue light 32-2 is illuminated.

From step 82, the method advances to step 84 where one or more of the workers denied access to the track level of pathway 8 between stations 64-1 and 64-2 obtains authorization to enter pathway 8.

In step 88, the S-BU unit 2 associated with blue light 32-2 determines if authorization has been granted/received. If not, the method loops on steps 86, 88 and 90 until authorization is granted. Thereafter, the method advances to step 80 where the color green 16-1 of said S-BU unit 2 is illuminated.

Upon exiting step 80, the method advances to steps 94-1-94-5 and step 96. In step 94-1, the blue light 32-1 associated with the S-BU unit 2 at the other end of station 64-1 is illuminated continuously. In step 92-4, the blue light 32-2 associated with the S-BU unit 2 where the workers tagged in is caused to flash. In step 94-3 and 94-4, the blue lights 52-1 and 52-2 associated with T-BU units 4 along the track level of pathway 8 are caused to flash. In step 94-5, the blue light 32-3 associated with the S-BU unit 2 at the end of station 64-2 closest to blue light 32-2 is also caused to flash. In step 96, the VDM 14 associated with the S-BU unit 2 controlling blue light 32-3 is also activated to detect for the presence of a vehicle (train) 15 entering the section of pathway 8 between stations 64-1 and 64-2 from the direction of station 64-2.

Thereafter, in step 98, the workers enter the section (track level) of pathway 8 from station 64-1. The method then advances to step 100 in FIG. 11.

With reference to FIGS. 11-15 and with continuing reference to all previous Figs., as the workers pass each T-BU unit 4 associated with a blue light 54 along the section of pathway 8 between stations 64-1 and 64-2, one designated worker (the leader) tags in via the reader 42 of said T-BU unit 4. For the purposes of description, it will be assumed that only one worker tags in at each T-BU unit 4. However, as noted above, this is not to be construed as limiting the invention.

Figure 11:
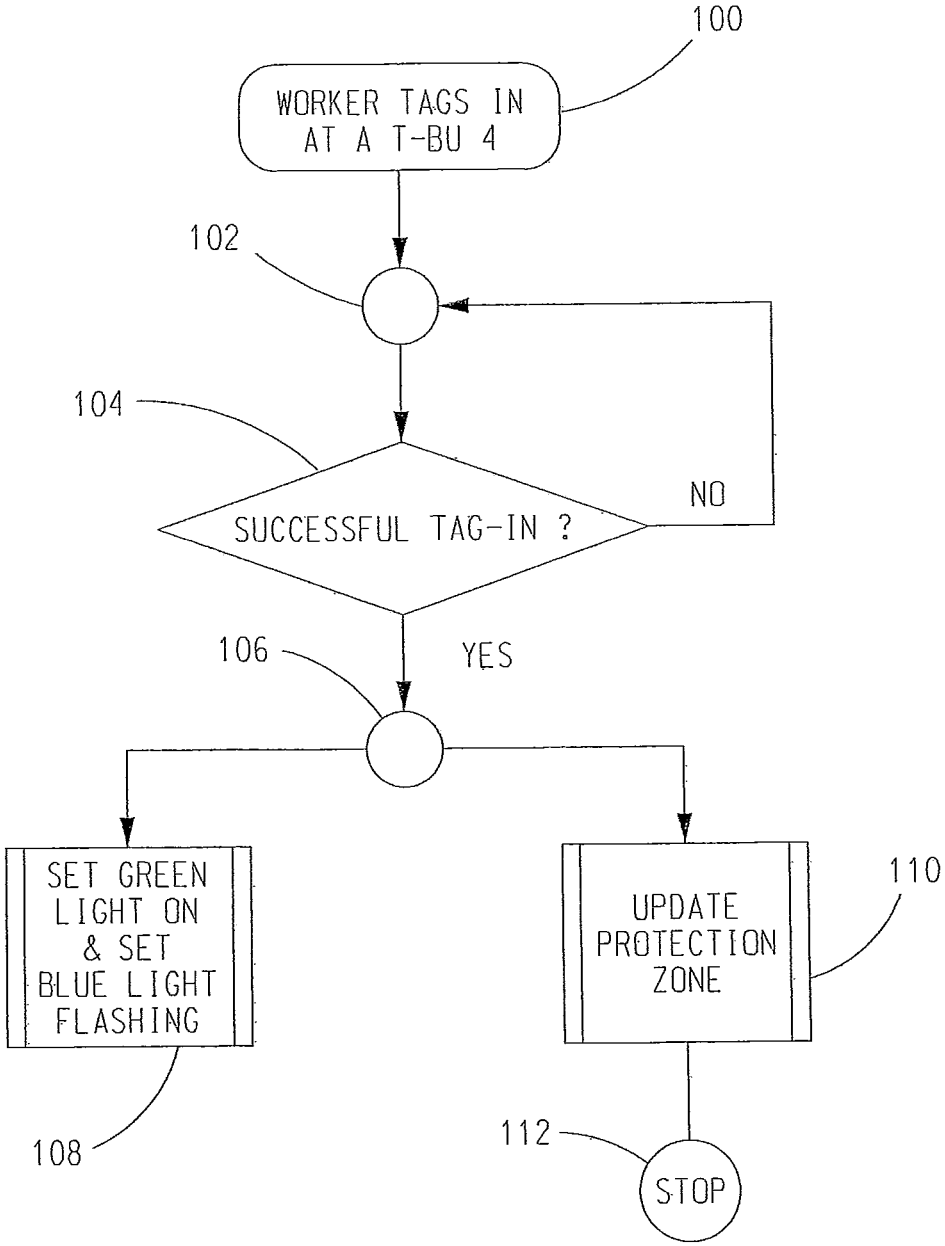
FIG. 11 is a flow diagram of a method executed by each T-BU in response to workers tagging in at the T-BU.
Figure 12:
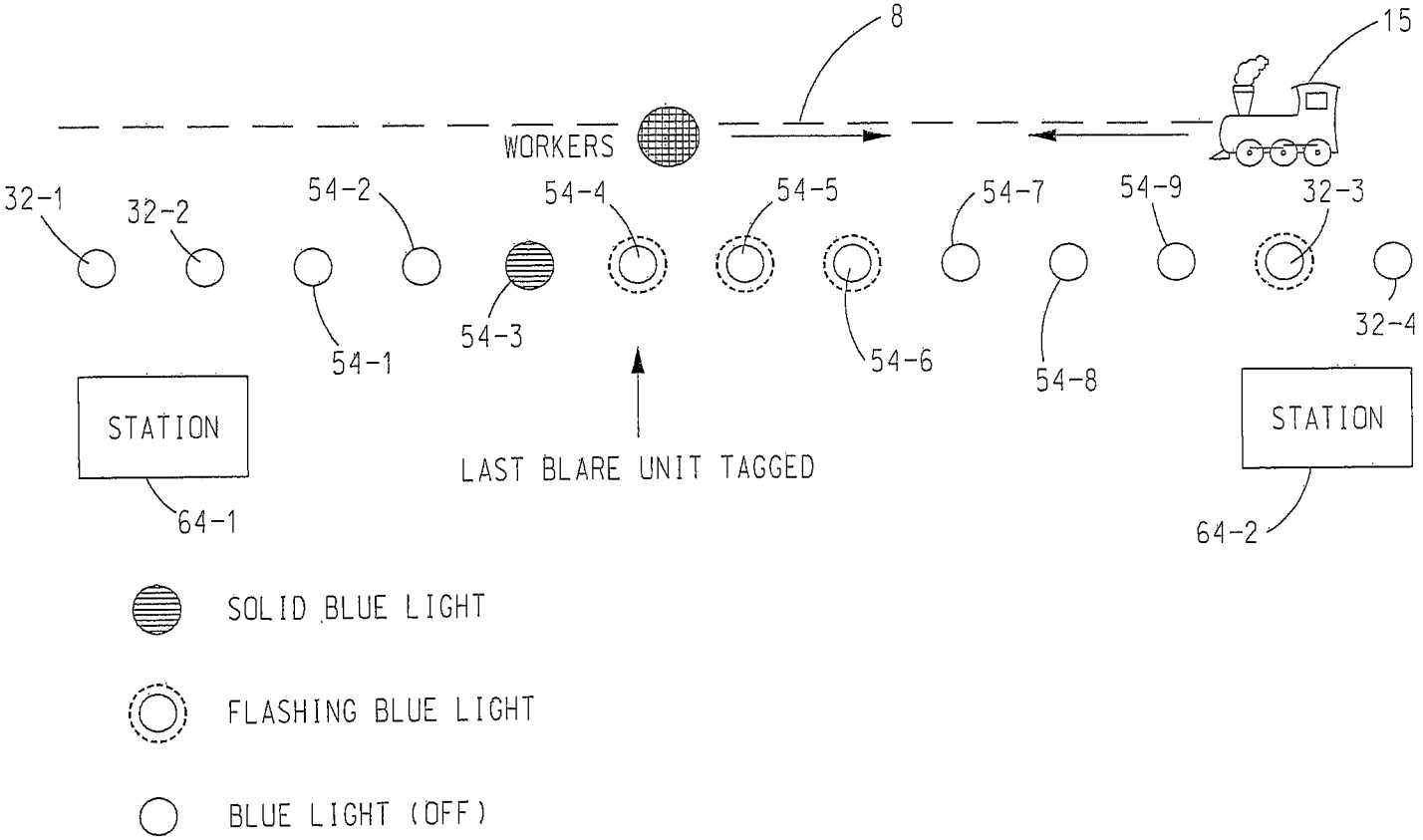
FIGS. 12-16 are diagrammatic views of the blue lights, stations, pathway and vehicle of FIG. 10 further showing how the illumination of the blue lights change in response to workers' tagging in at different T-BUs and S-BUs along the pathway that extends between the stations.

With specific reference to FIGS. 11 and 12, assuming that a group of workers has walked along pathway 8 and that one of said workers (the leader) has just tagged in at the T-BU unit 4 associated with blue light 54-4, desirably after sequentially tagging in at the T-BU units 4 associated with blue lights 54-1-54-3, blue lights 54-4-54-6 are caused to flash and blue light 54-3 is illuminated constantly. Blue light 32-3, which was caused to begin flashing when the workers were authorized to enter the track level of pathway 8, is caused to remain flashing.

More specifically, in step 100, one or more workers tag in at T-BU unit 4 associated with blue light 54-4. In step 104, a decision is made by said T-BU unit 4 if the tag-in was successful. If so, the method advances to steps 108 and 110. In step 108, the color green 36-1 of said T-BU unit 4 is illuminated to indicate a successful tag read and blue light 54-4 is set to a flashing state. In step 110, blue lights 54-5 and 54-6 are set to a flashing state; blue light 54-2 is turned from a continuously-on state to an off state; and blue light 54-3 is set from a flashing state to a continuously-on state. The method then advances to stop step 112. Steps 100-112 represent the steps utilized to update the location of an active protection zone for the workers in the section of the track level of pathway 8 between stations 64-1 and 64-2 in response to one or more of said workers sequentially tagging in at each T-BU unit 4 along pathway 8.

Figure 13:
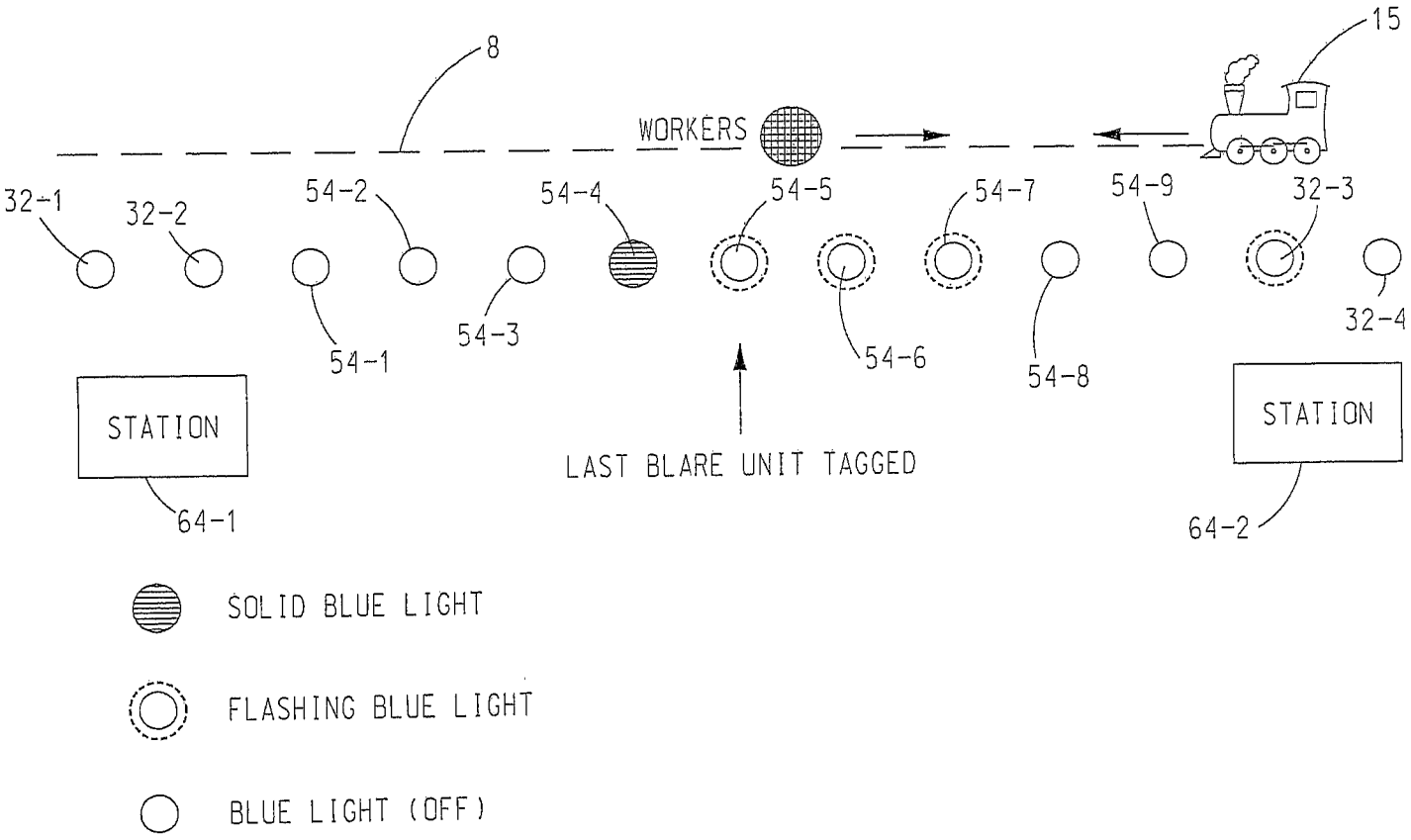

With reference to FIG. 13 and with continuing reference to FIGS. 11 and 12, starting with blue lights 54-3-54-6 and 32-3 illuminated in the manner shown in FIG. 12, assume that the leader next tags in at the T-BU unit 4 associated with blue light 54-5. In response to this tag in, blue light 54-3 is switched from the continuously-on state shown in FIG. 12 to an off state; blue light 54-4 is switched from a flashing state to a continuously-on state; blue lights 54-5 and 54-6 are maintained in their flashing state; and blue light 54-7 is set from the off state shown in FIG. 12 to a flashing state shown in FIG. 13. Thus, as can be seen, as workers progress along pathway 8 from station 64-1 to station 64-2, in response to the leader tagging in at each T-BU unit 4 along pathway 8, the subset of blue lights 54 that are off, flashing, and continuously on will change with the movement of said workers.

In a similar manner, assuming that the workers move along pathway 8 from station 64-2 toward station 64-1, and in response to the leader tagging in at each T-BU unit 4 along pathway 8, the subset of blue lights 54 that are off, flashing, and continuously on will change in an opposite manner to when the workers are moving from station 64-1 to 64-2. For example, starting from the state shown in FIG. 13 where blue light 54-4 is continuously on and blue lights 54-5 and 54-7 are flashing, if the workers move towards station 64-1 and the leader tags in at the T-BU unit 4 associated with blue light 54-4, blue light 54-3 will be set to a continuously-on state; blue light 54-4 will change from a continuously-on state to a flashing state, blue lights 54-5 and 54-6 will remain in a flashing state; and blue light 54-7 will change from a flashing state to an off state, as shown in FIG. 12.

Desirably, the state of each blue light 54 (continuously on, flashing, or off) in response to workers (of the leader) tagging in at each T-BU unit 4 associated with said blue lights 54 is controlled by the S-BU unit 2 where said workers initially tagged in and were granted access to the section of pathway 8 between stations 64-1 and 64-2 via the computer network connecting said S-BU unit 2 with the T-BU units 4 controlling blue lights 54 along said section of pathway 8. Desirably, the S-BU unit 2 where the workers initially tagged in and were granted access to the track level associated with pathway 8 between stations 64-1 and 64-2 also coordinates and/or controls the state of the blue light 32-3 (continuously on, flashing, or off) associated with the S-BU unit 2 of station 64-2.

The number of blue lights 54 described herein that are flashing, continuously on and off is not to be construed as limiting the invention since it is envisioned that any number of blue lights in both directions can be set in any desired state (flashing, continuously on, or off) in order to define the "protection zone" for the workers. Thus, for example, a protection zone for the workers may be defined by one or more flashing blue lights 54 and one or more blue lights 54 in a continuously-on state without limit Similarly, the number of flashing blue lights 54 defining a protection zone for workers is not strictly limited to three sequential blue lights, e.g., blue lights 54-4-54-6 in FIG. 12. Rather, an additional blue light, e.g., blue light 54-8, can be set to a flashing state and can be separated from flashing blue lights 54-4-54-6 by a blue light 54-7 which is maintained in an off state.

Figure 14:
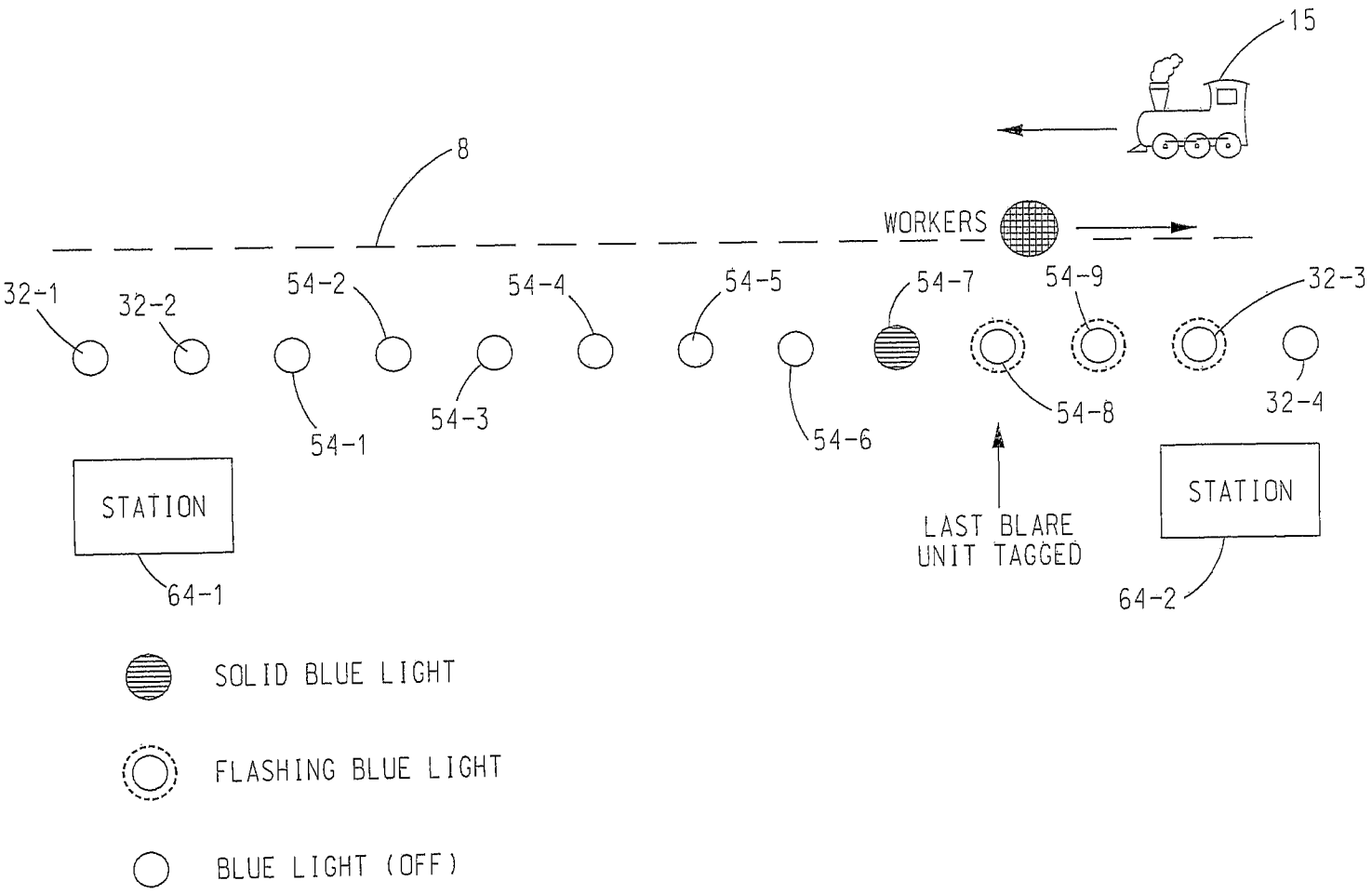

With reference to FIG. 14, as the workers progress along pathway 8 toward station 64-2, the leader tags in at each T-BU unit 4 associated with a blue light 54 along pathway 8. Upon tagging in at the T-BU unit 4 associated with blue light 54-8 (the penultimate blue light 54 before the workers reach station 64-2), blue lights 54-8, 54-9, and 32-3 are caused to remain in a flashing state, blue light 54-7 is set to a continuously-on state, and blue light 54-6 is set to an off state from a continuously-on state.

Figure 15:
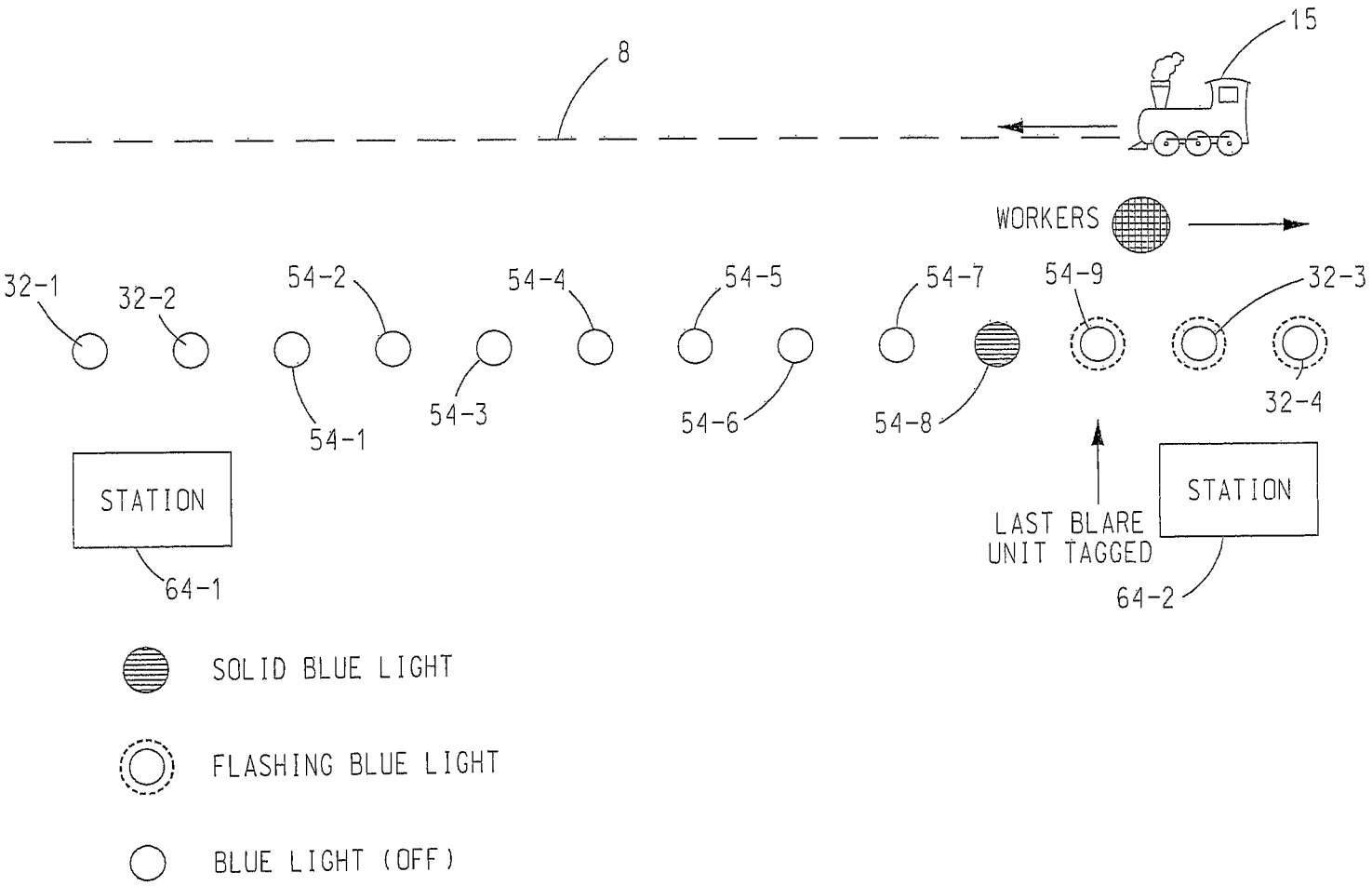

With reference to FIG. 15 and with continuing reference to FIG. 14, next, when the leader tags in at the T-BU unit 4 associated with blue light 54-9, blue lights 54-9 and 32-3 remain in their flashing state; blue light 32-4 is set to a flashing state from the off state shown in FIG. 14; blue light 54-8 is set to a continuously-on state from the flashing state shown in FIG. 14; and blue light 54-7 is set to an off state from the continuously-on state shown in FIG. 14.

Figure 16:
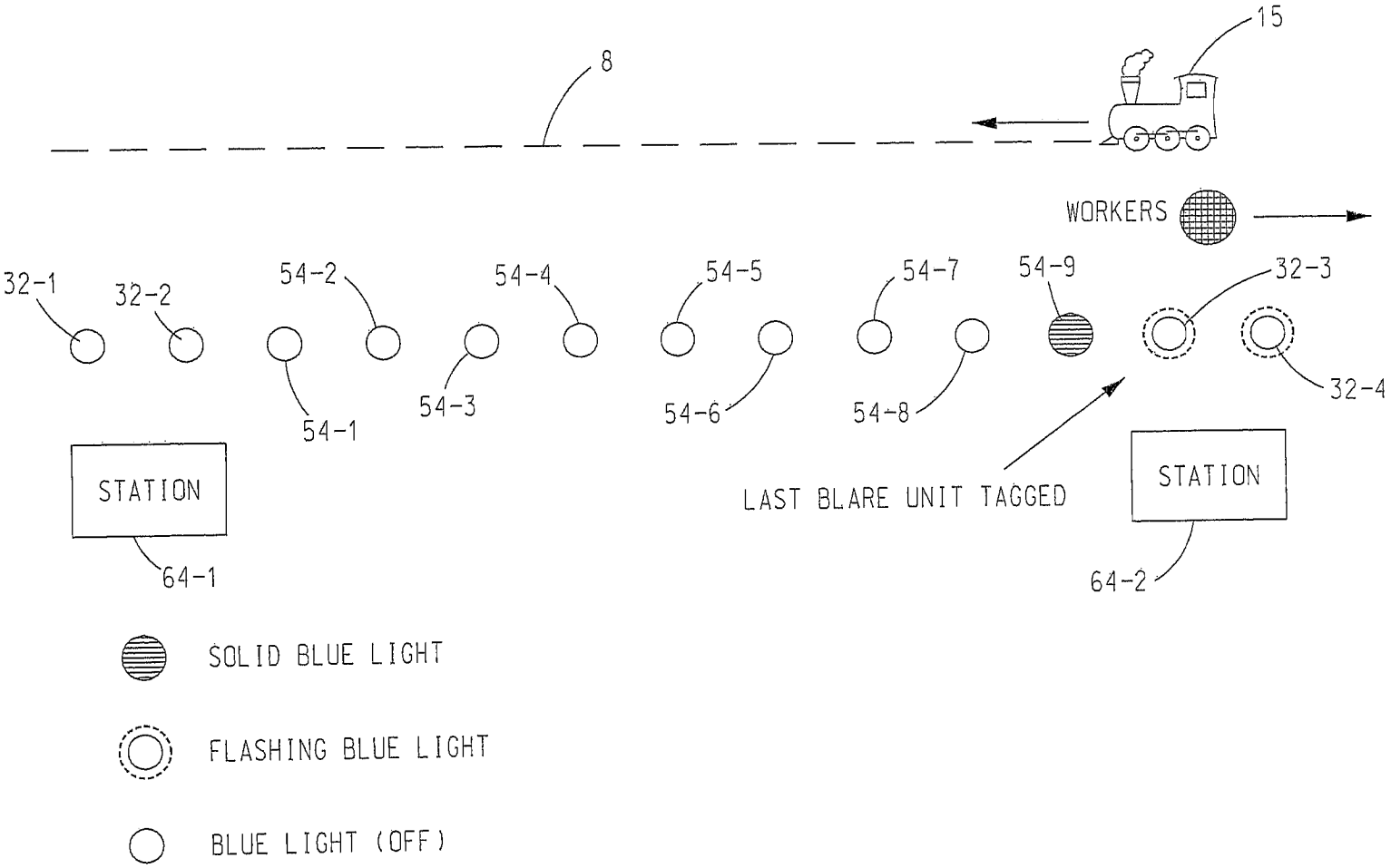

With reference to FIG. 16 and with continuing reference to FIGS. 14 and 15, assuming that the workers tag out at the S-BU unit 2 associated with blue light 32-3, blue lights 32-3 and 32-4 remain in a flashing state; blue light 54-9 is set to a continuously-on state from the flashing state shown in FIG. 15; and blue light 54-8 is set to an off state from the continuously-on state shown in FIG. 15.

Prior to the workers tagging out at the S-BU unit 2 associated with blue light 32-3, the EXIT button of said S-BU unit 2 is activated. In response to activation of this EXIT button, said S-BU unit 2 sets the states of blue lights 54-9, 32-3 and 32-4 as shown in FIG. 16 and generates a prompt on the LCD 18 of said S-BU unit 2 for the workers to "tag out" via the reader 24 associated with said S-BU unit 2 reading the RFID tags of each worker in the group. In response to all of the workers tagging out within a pre-determined interval of time after activating the EXIT button, the S-BU unit 2 associated with blue light 32-2 deactivates its VDM 14 and causes all of the blue lights 32 and 54 defining the active protection zone to turn off.

Information regarding all of the workers tagging out within the pre-determined interval of time can be dispatched by the S-BU unit 2 associated with blue light 32-3 for storage at transit control 12 via CDP 10. On the other hand, if all the workers do not tag out within the pre-determined interval of time, a notice of this can be dispatched to transit control 12 via CDP 10 for appropriate resolution and blue lights 54-9, 32-3 and 32-4 can be caused to remain in their illuminated states.

On the other hand, if the workers return to tag out at the S-BU unit 2 associated with blue light 32-2, in response to activation of the EXIT button of said S-BU unit 2, blue light 32-1 will be set to its continuously-on state and blue lights 32-2, 52-1, and 52-2 will be set to their flashing state, in the same manner as when the workers were entering the track level of pathway 8 via said S-BU unit 2 associated with blue light 32-2 as shown in FIG. 10. Upon tagging out at the S-BU unit 2 associated with blue light 32-2 within the pre-determined interval of time after activating the EXIT button, the VDM 14 associated with the S-BU unit 2 associated with blue light 32-3 is caused to turn off and blue lights 32-1, 32-2, 52-1, and 52-2 are set to their off state. On the other hand, if all the workers do not tag out within the pre-determined interval of time, a notice of this can be dispatched to transit control 12 via CDP 10 for appropriate resolution and blue lights 32-1, 32-2, 52-1, and 52-2 can be caused to remain in their illuminated states.

In the case where workers desire to enter the track level of pathway 8 between stations 64-1 and 64-2 from station 64-2, said workers will initially tag in and be granted access to the track level of pathway 8 via the S-BU unit 2 associated with blue light 32-3. In this case, blue lights 32 and 54 can be set to the continuously-on, flashing, and off states shown in FIG. 15 or FIG. 16. Also or alternatively, blue lights 32 and 54 can be set to the continuously-on, flashing, and off states as shown in FIG. 16 and, in addition, a blue light 54 (not shown) to the right of blue light 32-4 can also be set to a flashing state. Hence, workers can enter the section of pathway 8 between stations 64-1 and 64-2 from either station 64-1 or 64-2.

Desirably, the flashing blue lights that defined each active protection zone extend from the continuously-on blue light thereof toward the direction of the oncoming vehicle (train) 15 on pathway 8 to warn the train operator of the presence of the workers on the track level of pathway 8. Conversely, the continuously-on blue light of each protection zone is the final blue light vehicle 15 will pass, thereby informing the vehicle operator of the end of the active protection zone.

The operation of an off-track BLARE (O-BU) unit 6 will now be described with reference to FIGS. 1 and 6-8.

At a suitable time when workers desire to enter an off-track location, such as a vent shaft, a power room, and the like, after being on the track level of pathway 8 having blue lights 52-3-52-6 and 32-3 in the states shown in FIG. 8, for example, said workers access an O-BU unit 6 associated with said off-track entry point. Specifically, the EXIT button of said O-BU unit 6 is activated and each worker tags out via the reader 62 of said O-BU unit 6. In response to each worker tagging out within a pre-determined interval of time, the O-BU unit 6 dispatches an indication of this to transit control 12 via CDP 10 shown in FIG. 1. On the other hand, if all of the workers do not tag out within the pre-determined interval, O-BU unit 6 dispatches an indication of this to transit control 12 via CDP 10 for appropriate resolution.

Assuming all the workers have tagged out via the reader 62 of O-BU unit 6, each VDM 14 along the section of pathway 8 between stations 64-1 and 64-2 is deactivated, the state of each blue light 32 and 52 (continuously on, flashing, or off) between stations 64-1 and 64-2, inclusive, is stored, and said blue lights are set to the off state.

At a suitable time when the workers desire to return to the track level of pathway 8 between stations 64-1 and 64-2 from the off-track location, either the left or the right arrow button of the O-BU unit 6 is activated. Thereafter, each worker tags in via reader 62 of the O-BU unit 6.

Under the control of the S-BU unit 2 where the workers initially tagged in and were granted access to the track of pathway 8, authorization for the workers to reenter the track level of pathway 8 from an off-track location is either granted or denied by illumination of the green color 54-1 or the red color 54-3 of O-BU unit 6. If delayed access is granted, the yellow color 54-2 is illuminated until a time that the workers may enter the track level, whereupon the green light 54-1 is illuminated.

At a suitable time after the workers have been granted access back to the track level of pathway 8 from the off-track location, blue lights 52 and 32 are set to the same state (continuously on, flashing, or off) that they were in when the workers entered the off-track location. Once the workers have reentered the track level of pathway 8, the workers can tag in at each T-BU unit 4 in the manner described above depending on the direction that the workers are traveling, i.e., either toward station 64-1 or toward station 64-2.

The operation of BLARE units 2 and 4 coupled to blue lights 32 and 54 in response to vehicle (train) 15 approaching an active protection zone, vehicle 15 passing through the active protection zone, and vehicle 15 exiting the active protection zone will now be described with reference to FIGS. 17-20.

In the following description, each BLARE unit 2 and 4 is coupled to a blue light 32 and 54 that is positioned to be viewed by an operator of vehicle 15 approaching an active protection zone. Each BLARE unit 2 and 4 can optionally include a blue light 32 and 54 that faces in the direction of the movement of vehicle 15. In FIGS. 17-20, blue lights that face in the direction of oncoming vehicle 15 will include an "A" suffix, e.g., 32-2A, 54-1A, etc., while blue lights that face in the direction of the movement of vehicle 15 will include a "B" suffix, e.g., 32-2B, 54-1B, etc.

Figure 17:
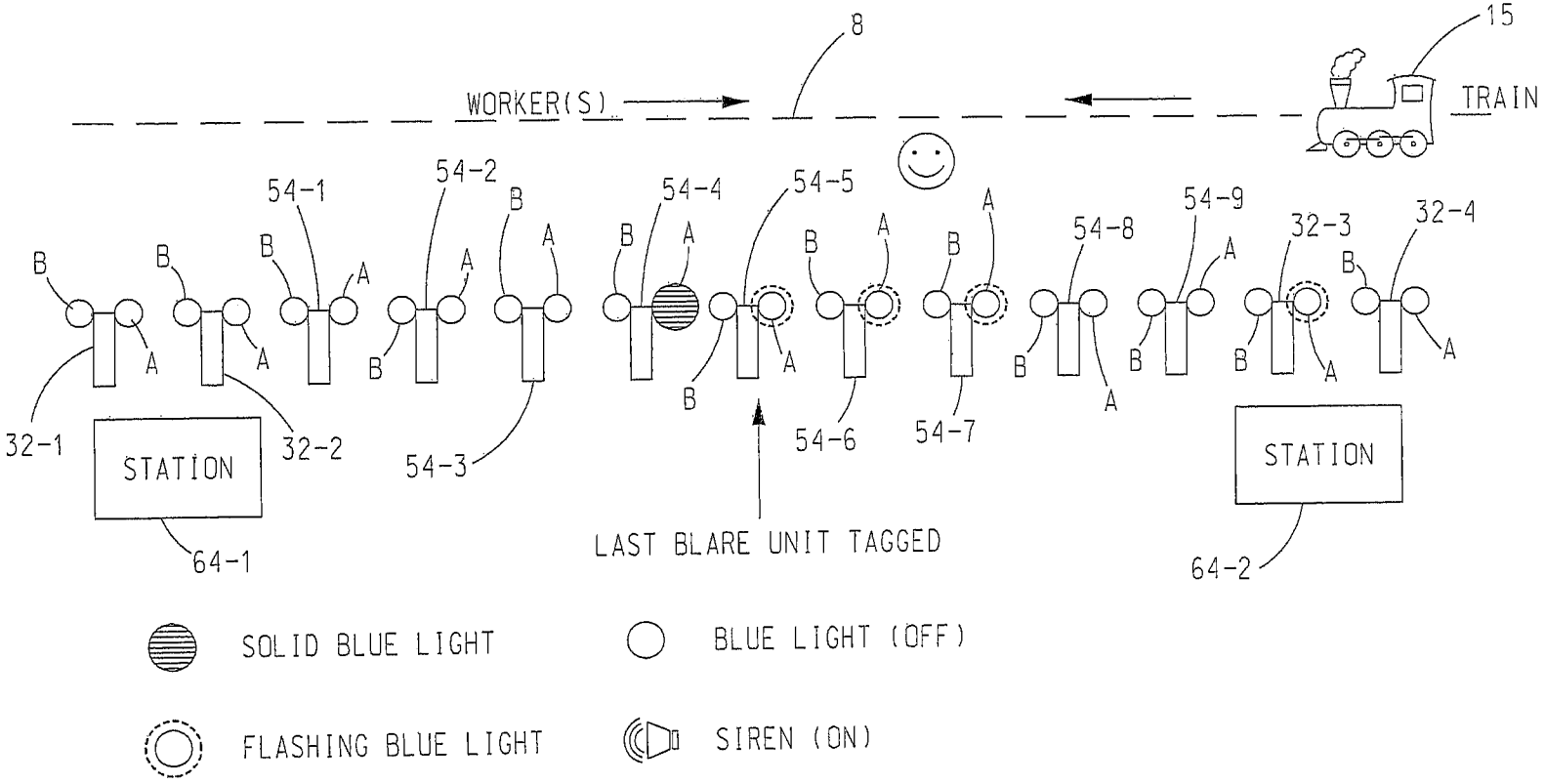
FIGS. 17-20 are diagrammatic views of the blue lights, stations, pathway and vehicle of FIG. 10 further including additional blue lights (denoted by the "B" suffix) showing the response of the blue lights to the vehicle moving into, through, and out of a protection zone defined by the illuminated blue lights.

With reference to FIG. 17, starting from a state where workers have tagged in to the T-BU unit 4 associated with blue lights 54-5A and 54-5B, blue light 54-4A is set to a continuously-on state and blue lights 54-5A, 54-6A, 54-7A, and 32-3A are set to or are caused to remain in a flashing state.

Figure 18:
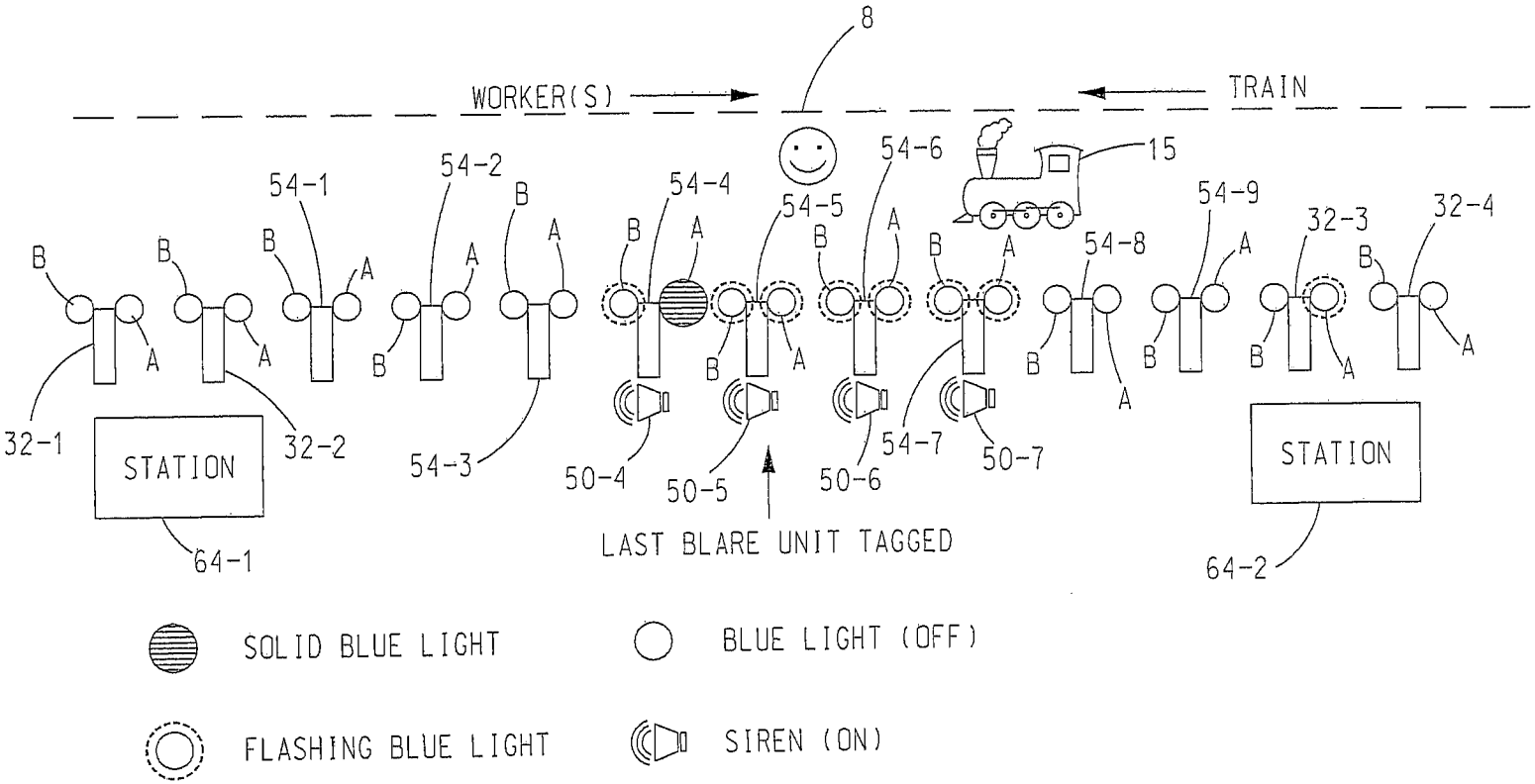

With reference to FIG. 18 and with continuing reference to FIG. 17, in response to vehicle 15 entering the active protection zone, one or more sirens 50-4-50-7 of the T-BU units 4 associated with one or more of blue lights 54-4-54-7 are activated to output an audible sound that is capable of warning the workers in the active protection zone that vehicle 15 is moving into or presently in the protection zone. Herein, each active protection zone is bounded by the blue light 54 that is continuously on and the flashing blue light 54 that is first encountered by vehicle 15. In FIG. 18, the active protection zone is bounded by blue lights 54-4A and 54-7A. However, this is not to be construed as limiting the invention since it is envisioned that the protection zone can include any suitable and/or desirable number of flashing and/or continuously-on blue lights 54 and 32.

If present, optional blue lights 54-4B, 54-5B, 54-6B, and 54-7B can be set to a flashing state to provide a visual notice to the workers in the active protection zone that vehicle 15 is entering or is in the protection zone. Blue lights 54-4B, 54-5B, 54-6B, and 54-7B can be used in combination or alternatively to the use of sirens 50-4, 50-5, 50-6, and 50-7.

The operation of blue lights 54-1-54-9 is under the control of the S-BU unit 2 associated with blue light 32-2, the S-BU unit 2 associated with blue light 32-3, or under the coordinated control of the S-BU units 2 associated with both blue lights 32-2 and 32-3. One or more VDMs 14 coupled to one or both of the S-BU units 2 associated with blue lights 32-2 and 32-3 can be utilized to detect the presence of vehicle 15 entering the active protection zone.

Figure 19:
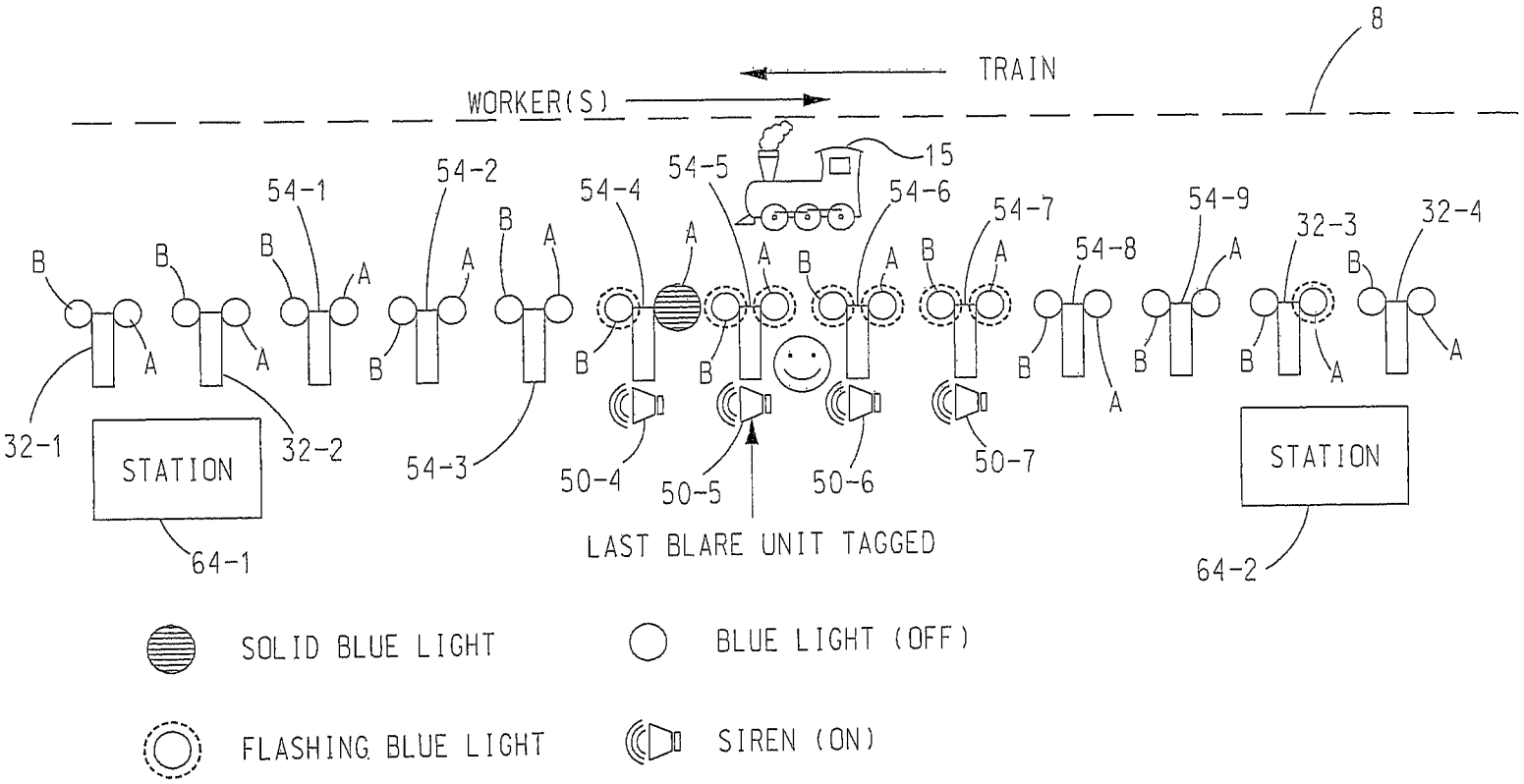

With reference to FIG. 19 and with continuing reference to FIGS. 17 and 18, in response to vehicle 15 moving through the active protection zone, the workers desirably move away from the track level of pathway 8 to avoid potential injury caused by the passage of vehicle 15 by the workers. As shown in FIG. 19, during passage of vehicle 15 through the protection zone, blue light 54-4A is set to a continuously-on state and blue lights 54-5A, 54-6A, and 54-7A are set to a flashing state. If provided, optional blue lights 54-4B-54-7B are also set to a flashing state to warn the workers of the presence of vehicle 15 in the active protection zone. Also or alternatively to the use of blue lights 54-4B-54-7B, sirens 50-4-50-7 can be activated to output sound during the passage of vehicle 15 through the active protection zone.

Figure 20:
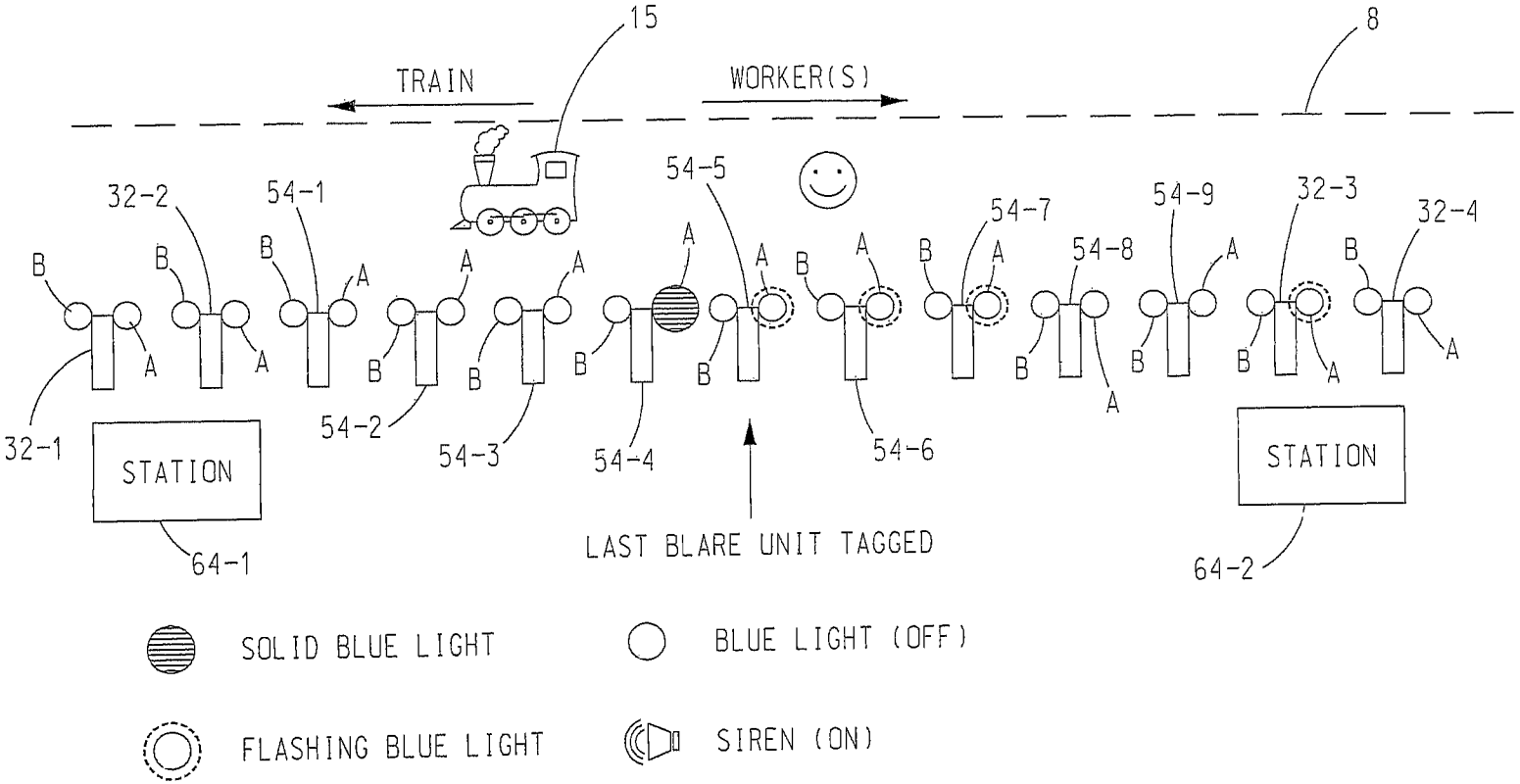

Lastly, with reference to FIG. 20, upon vehicle 15 exiting the active protection zone, blue lights 54-5A-54-7A are maintained in the state shown in FIG. 17 before vehicle 15 entered the protection zone. If optional blue lights 54-4B-54-7B are provided, these blue lights return to an off state from the flashing state shown in FIG. 19. Lastly, if sirens 50-4-50-7 were activated during the passage of vehicle 15 through the protection zone, these sirens are silenced.

As can be seen, the present invention is a system and method of tracking the movement of workers on the track level of a pathway 8 of a vehicle 15. Vehicle 15 can be any suitable and/or desirable vehicle including, without limitation, a tired vehicle, a rail vehicle, etc. The invention provides a means to have a protection zone that moves with movements of the workers along pathway 8 as the workers tag in to T-BU units 4 along the length of pathway 8. Each active protection zone can include a light that is set to a continuously-on state at one end and one or more flashing lights extending from said continuously-on light in the direction of the oncoming vehicle 15. Upon seeing the flashing lights, the operator of vehicle 15 will know he is entering an active protection zone where workers are present. Upon seeing the light that is continuously on, the operator of vehicle 15 will know that he is exiting the protection zone.

A protection zone can extend along any suitable and/or desirable length of pathway 8, including along the length of pathway 8 that includes one or more stations 64.

The computer network created by S-BU units 2 and T-BU units 4, and, optionally O-BU unit 6, CDP 10, and transit control 12, facilitates controlled access to the track level of pathway 8 by workers. To this end, workers are desirably preauthorized access to the track level of pathway 8. The computer network tracks the location of workers along the track level of pathway 8 in response to one or more of said workers tagging in at T-BU units 4 distributed along the length of pathway 8. In one embodiment, all workers are required to tag in to each T-BU unit 4 along the length of pathway 8. In another embodiment, one worker (the leader) of a group of workers is required to tag in at each T-BU unit 4 along the length of pathway 4, whereupon the system is programmed to assume that all of the workers are moving in concert with the leader along the length of pathway 8.

The blue lights of each protection zone are set to a continuously-on state or flashing state to indicate to the operator of vehicle 15 where the protection zone starts and ends. Also, or alternatively, another set of blue lights can be set to a desired state (continuously on or flashing) as desired to act as a warning to the workers in the protection zone of the presence of vehicle 15 moving through the protection zone. Still further, sirens operating under the control of the T-BU units 4 defining the active protection zone can be turned on to output a sound to announce to the workers the presence of vehicle 15 moving through the current protection zone.

The present invention has been described with reference to desirable embodiments. Obvious modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A computer-implemented method for providing warning notifications about one or more track workers along a track, the method comprising:

detecting presence of the one or more track workers along the track via a network of detectors coupled to a communications network; and controlling broadcast of one or more human-perceivable indications across the communications network to one or more broadcast units based on the presence of the track workers.

2. The method of claim 1, wherein detecting the presence of the one or more track workers comprises detecting one or more devices on the one or more track workers.

3. The method of claim 1, comprising detecting the presence of at least one train on the track.

4. The method of claim 1, wherein generating the one or more human-perceivable indications comprises generating a visual indication or an audible indication.

5. The method of claim 4, comprising generating the visual indication as a flashing light at the one or more broadcast units.

6. The method of claim 4, comprising generating the audible indication as an audible message at the one or more broadcast units.

7. The method of claim 3, further comprising alerting a train operator within the one or more trains using the visual indication.

8. The method of claim 7, comprising generating the visual indication in a vicinity of the one or more track workers or in a vicinity of the one or more trains such that the visual indication is noticeable by the one or more track workers or the train operator.

9. The method of claim 8, comprising controlling the visual indication based on movement of the one or more track worker or the one or more trains.

10. The method of claim 1, comprising generating a human-perceivable indication to the one or more track workers confirming detection of the presence of the one or more track workers.

11. The method of claim 10, comprising generating a caution message as part of the human-perceivable indication.

12. The method of claim 5, comprising controlling the frequency of the flashing light.

13. The method of claim 6, comprising generating one of a pre-recorded or a live message as part of the audible message.

14. The method of claim 1, comprising selecting some or all of the broadcast units for output of the one or more human-perceivable indications.

15. A system for providing notification of the presence of one or more track workers along a track, the system comprising:

one or more identification readers situated along a length of the track and operative for reading one or more identification tags carried by the one or more track workers;

one or more beacons situated along the length of the track for broadcasting notifications regarding the location of the one or more track workers along the track; and a communication network linking the tag readers and the beacons to a processor controlled data processing system.

16. The system of claim 15, wherein at least one identification reader includes a human machine interface to allow one of the track workers to input data into the data processing system.

17. The system of claim 15, further comprising one or more broadcast units, each broadcast unit integrating at least one identification reader and at least one beacon.

18. The system of claim 17, each broadcast unit is networked via the communication network and controlled by the data processing system.

19. The system of claim 15, wherein each beacon includes means for providing a visual indication, an audible indication, or both.

20. The system of claim 15, wherein each identification reader includes means to confirm identification of the one or more track workers.

21. The system of claim 15, wherein more than one beacon broadcasts the notifications.

22. The system of claim 15, wherein the communication network is a wired communication network, a wireless communication network, or a combination of a wired and wireless communication network.

23. The system of claim 15, wherein the communication network is a wired communication network comprising one or more of the following: network-based communication, optics-based communication, and cable-based communication.

* * * * *

UNITED STATES PATENT AND TRADEMARK OFFICE

CERTIFICATE OF CORRECTION

PATENT NO. : 8,786,428 B2
APPLICATION NO. : 13/097403
DATED : July 22, 2014
INVENTOR(S) : Sheardown et al.

It is certified that error appears in the above-identified patent and that said Letters Patent is hereby corrected as shown below:

On the Title page, Item [75] Fourth Inventor, delete "Nerraj" and insert -- Neeraj --

Signed and Sealed this
Third Day of March, 2015

Michelle K. Lee

Michelle K. Lee
*Deputy Director of the United States Patent and Trademark Office*